US011637387B2

(12) United States Patent
Wu et al.

(10) Patent No.: US 11,637,387 B2
(45) Date of Patent: Apr. 25, 2023

(54) COAXIAL AND CLUSTER CONNECTOR ASSEMBLIES

(71) Applicant: CommScope Technologies LLC, Hickory, NC (US)

(72) Inventors: JianPing Wu, Jiangsu (CN); Yujun Zhang, Jiangsu (CN); Lei Tie, Jiangsu (CN); Jien Zheng, Jiangsu (CN)

(73) Assignee: CommScope Technologies LLC, Hickory, NC (US)

( * ) Notice: Subject to any disclaimer, the term of this patent is extended or adjusted under 35 U.S.C. 154(b) by 13 days.

(21) Appl. No.: 17/345,221

(22) Filed: Jun. 11, 2021

(65) Prior Publication Data

US 2022/0029316 A1 Jan. 27, 2022

(30) Foreign Application Priority Data

Jul. 24, 2020 (CN) ..... 202010721390.7
Jul. 24, 2020 (CN) ..... 202010721391.1
Aug. 12, 2020 (CN) ..... 202010804601.3

(51) Int. Cl.
*H01R 9/05* (2006.01)
*H01R 24/40* (2011.01)
(Continued)

(52) U.S. Cl.
CPC ..... *H01R 9/0506* (2013.01); *H01R 13/518* (2013.01); *H01R 13/627* (2013.01);
(Continued)

(58) Field of Classification Search
CPC .. H01R 9/0506; H01R 13/502; H01R 13/518; H01R 13/622; H01R 13/623;
(Continued)

(56) References Cited

U.S. PATENT DOCUMENTS 3,671,922 A * 6/1972 Zerlin ..... H01R 9/0518 439/352
9,310,570 B2 * 4/2016 Busse ..... G02B 6/3879
(Continued)

FOREIGN PATENT DOCUMENTS

CN 106159552 A 11/2016
CN 210051929 U 2/2020
KR 20100083352 A 7/2010

OTHER PUBLICATIONS

"International Search Report and Written Opinion corresponding to International Application No. PCT/US2021/036726 dated Oct. 1, 2021".

*Primary Examiner* — Oscar C Jimenez
(74) *Attorney, Agent, or Firm* — Myers Bigel, P.A.

(57) ABSTRACT

The present disclosure relates to a coaxial connector assembly comprising a first connector and a second connector adapted to be connected with each other, and a locking mechanism adapted to lock and unlock a connection between the first connector and the second connector. The locking mechanism includes a first locking member having at least one elastic snap-fit element and a second locking member having a locking element adapted to be snap-fitly engaged with the at least one elastic snap-fit element. The first locking member is disposed on an outer periphery of the first connector, and the second locking member is disposed on an outer periphery of the second connector. The elastic snap-fit element is constructed as a cantilever that extends axially toward a direction remote from the second connector, so that it is movable between an unlocking position and a locking position along a radial direction. In the unlocking position, the elastic snap-fit element is pressed down, so that the elastic snap-fit element is disengaged from the locking element, and in the locking position, the elastic snap-fit
(Continued)

element springs back to its initial state, so that the elastic snap-fit element is snap-fitly engaged with the lock element.

18 Claims, 16 Drawing Sheets

(51) Int. Cl.
*H01R 13/518* (2006.01)
*H01R 13/639* (2006.01)
*H01R 13/627* (2006.01)
*H01R 107/00* (2006.01)

(52) U.S. Cl.
CPC ..... *H01R 13/639* (2013.01); *H01R 24/40* (2013.01); *H01R 2107/00* (2013.01)

(58) Field of Classification Search
CPC .. H01R 13/625; H01R 13/627; H01R 13/629; H01R 13/639; H01R 13/6275; H01R 13/6277; H01R 24/40
See application file for complete search history.

(56) References Cited

U.S. PATENT DOCUMENTS

| | | | | |
|---|---|---|---|---|
| 10,944,211 | B1 * | 3/2021 | Ho | H01R 13/622 |
| 11,121,503 | B1 * | 9/2021 | Kan | H01R 13/639 |
| 2006/0051999 | A1 * | 3/2006 | Allemann | H01R 13/622 439/320 |
| 2006/0194465 | A1 | 8/2006 | Czikora | |
| 2008/0139038 | A1 * | 6/2008 | Lee | H01R 13/633 439/382 |
| 2018/0040978 | A1 * | 2/2018 | Blakborn | H01R 13/508 |
| 2018/0123288 | A1 * | 5/2018 | Shao | H01R 13/28 |
| 2020/0021055 | A1 | 1/2020 | Wu et al. | |

* cited by examiner

COAXIAL AND CLUSTER CONNECTOR ASSEMBLIES

RELATED APPLICATIONS

The present application claims priority to and the benefit of Chinese Patent Application Nos. 202010721390.7, filed Jul. 24, 2020; 202010721391.1, filed Jul. 24, 2020, and 202010804601.3, filed Aug. 12, 2020, the disclosures of which are hereby incorporated by reference herein in full.

FIELD OF THE INVENTION

The present disclosure generally relates to the field of electrical cable connectors. More particularly, the present disclosure relates to a coaxial connector assembly.

BACKGROUND OF THE INVENTION

Coaxial cables are commonly utilized in radio frequency communication systems. A typical coaxial cable includes an inner conductor, an outer conductor, a dielectric layer that separates the inner and outer conductors, and a jacket that covers the outer conductor. Coaxial connectors may be applied to terminate coaxial cables, for example, in communication systems requiring a high level of precision and reliability.

Coaxial connector interfaces provide a connect/disconnect functionality between (a) a cable terminated with a connector bearing the desired connector interface and (b) a corresponding connector with a mating connector interface mounted on an electronic device or on another cable.

In general, coaxial connectors can be classified into male connectors and female connectors by type. A typical male connector generally includes: an inner contact (generally a pin or post) for connection with the inner conductor of the cable; an outer contact circumferentially surrounding the inner contact and spaced apart from the inner contact, the outer contact being generally used for connection with an outer conductor of a mating connector; and a dielectric spacer arranged between the inner contact and the outer contact. A typical female connector has a structure similar to the male connector, but the inner contact of the female connector is a sleeve that receives the inner contact (a pin or post) of the male connector in an interference fit.

Currently, there is also a type of ganged coaxial connector, which includes a plurality of unit coaxial connectors arranged as a single integrated component. The ganged coaxial connector is more and more widely used due to its convenient installation.

In the prior art, coaxial connector interfaces usually utilize a connecting nut to pull the coaxial connector pairs together to achieve a reliable electromechanical engagement. However, the tightening and untightening of the connecting nut is time-consuming, and loosening of the connecting nut may be occurred during the use of the coaxial connector, thereby affecting the electrical performance of the coaxial connector.

SUMMARY OF THE INVENTION

One of objects of the present disclosure is to provide a coaxial connector assembly, which is capable of overcoming one or more problems present in the prior art.

The present disclosure relates to a coaxial connector assembly comprising: a first connector and a second connector adapted to be connected with each other; and a locking mechanism adapted to lock and unlock a connection between the first connector and the second connector, wherein the locking mechanism includes a first locking member having at least one elastic snap-fit element and a second locking member having a locking element adapted to be snap-fitly engaged with the at least one elastic snap-fit element; wherein the first locking member is disposed on an outer periphery of the first connector, and the second locking member is disposed on an outer periphery of the second connector; and wherein the at least one elastic snap-fit element is constructed as a cantilever that extends axially toward a direction remote from the second connector, so that it is movable between an unlocking position and a locking position along a radial direction, wherein in the unlocking position, the at least one elastic snap-fit element is pressed down so that the at least one elastic snap-fit element is disengaged from the locking element to unlock the connection between the first connector and the second connector, and in the locking position, the at least one elastic snap-fit element springs back to its initial state, so that the at least one elastic snap-fit element is snap-fitly engaged with the locking element to lock the connection between the first connector and the second connector.

According to one embodiment of the present disclosure, one of the at least one elastic snap-fit element and the locking element includes a depressed portion, and the other of the at least one elastic snap-fit element and the locking element includes a raised portion, wherein in the locking position, the raised portion projects into the depressed portion to form a snap-fit engagement.

According to one embodiment of the present disclosure, the at least one elastic snap-fit element is constructed in a stepped shape, and the locking element includes a depressed portion for receiving a raised portion of the stepped shape and a stopper for blocking the raised portion from moving out of the depressed portion along an axial direction, wherein in the locking position, the raised portion of the stepped shape is received in the depressed portion and a stepped surface of the stepped shape abuts against the stopper.

According to one embodiment of the present disclosure, the second locking member is constructed as a locking sleeve, and the locking element is disposed inside the locking sleeve.

According to one embodiment of the present disclosure, in the locking position, a portion of the at least one elastic snap-fit element projects from the second locking member, so that the at least one elastic snap-fit element can be disengaged from the locking element by pressing down on the portion.

According to one embodiment of the present disclosure, the first locking member includes two elastic snap-fit elements spaced apart by 180°.

According to one embodiment of the present disclosure, the first locking member includes three or more elastic snap-fit elements uniformly distributed along a circumferential direction of the first connector.

According to one embodiment of the present disclosure, the first locking member includes a semicircular or a substantially circular body, and one end of each elastic snap-fit element is fixed on the body.

According to one embodiment of the present disclosure, each elastic snap-fit element includes an inclined section extending obliquely radially outwards from one side of the body toward a direction remote from the body and a horizontal section extending axially from the inclined section further toward the direction remote from the body.

According to one embodiment of the present disclosure, each elastic snap-fit element includes an inclined section extending obliquely radially outwards from one side of the body to the other side of the body and a horizontal section extending axially from the inclined section further toward the other side of the body.

According to one embodiment of the present disclosure, the body is fixed to the first connector by means of a pin or a screw.

According to one embodiment of the present disclosure, both ends of the body include openings, wherein the openings are buckled on raised portions provided on the outer periphery of the first connector to fix the first locking member to the first connector.

According to one embodiment of the present disclosure, the second locking member is slidably disposed on the outer periphery of the second connector along an axial direction.

According to one embodiment of the present disclosure, the second locking member is fixedly disposed on the outer periphery of the second connector.

According to one embodiment of the present disclosure, the coaxial connector assembly further comprises an unlocking sleeve axially slidably disposed on the outer periphery of the second connector for unlocking a snap-fit engagement of the at least one elastic snap-fit element with the locking element, wherein one end of the unlocking sleeve is provided with a flange extending radially inwards, and wherein the flange is configured to press down the at least one elastic snap-fit element to move it to the unlocking position.

According to one embodiment of the present disclosure, the flange of the unlocking sleeve includes an inclined surface to facilitate pressing down the at least one elastic snap-fit element.

According to one embodiment of the present disclosure, indicator marks are provided on outer peripheries of the first connector and the second connector for aligning the first connector with the second connector.

According to one embodiment of the present disclosure, the indicator marks are depressions, protrusions, or colored markers.

According to one embodiment of the present disclosure, a sealing element is provided on an inner periphery of the first connector for sealing an interface between the first connector and the second connector.

According to one embodiment of the present disclosure, the first locking member and/or the second locking member are metal members or injection molded members.

According to one embodiment of the present disclosure, the coaxial connector assembly is a ganged coaxial connector assembly, wherein one of the first connector and the second connector includes a plurality of male connector elements, and the other of the first connector and the second connector includes a plurality of female connector elements adapted to mate with the plurality of male connectors.

According to one embodiment of the present disclosure, each of the male connector elements is configured to be axially floatable by means of an elastic member.

According to one embodiment of the present disclosure, one of the first connector and the second connector includes at least one positioning element, and the other of the first connector and the second connector includes a mating element for mating with the at least one positioning element.

According to one embodiment of the present disclosure, the positioning element is constructed as a rib, and the mating element is constructed as a groove for receiving the rib.

According to one embodiment of the present disclosure, the positioning element includes a plurality of ribs which are spaced apart from each other by an uneven distance along a circumferential direction, and the mating element includes a plurality of grooves, each of which is configured to receive a corresponding one of the plurality of ribs.

According to one embodiment of the present disclosure, one of the first connector and the second connector includes a guide post, and the other of the first connector and the second connector includes a guide hole for receiving the guide post.

According to one aspect of the present invention, a cluster connector assembly system is provided. The cluster connector assembly system comprises a first connector assembly and a second connector assembly, wherein the first connector assembly has a housing having a first portion configured to integrate a plurality of first connectors together, and a second portion located radially outward of the first portion, wherein a split ring is axially constrainedly arranged on the second portion relative to the housing, the split ring is provided with one of a protrusion and a stop groove on its inner circumferential surface, and the split ring is elastically expandable and contractible in a radial direction, the second connector assembly has a housing configured to integrate a plurality of second connectors together, wherein the housing of the second connector assembly has the other of a protrusion and a stop groove, the first connector assembly and the second connector assembly are engageable and disengageable in a push-pull manner, and, when the first connector assembly and the second connector assembly enter an engaged state, the split ring is movable radially inwards based on its own elastic force, so that the protrusion enters the stop groove, thereby establishing self-locking of the first connector assembly and the second connector assembly.

In some embodiments, when the split ring is pressed radially outward, the split ring is movable radially outward by overcoming its own elastic force, thereby causing the protrusion to leave the stop groove, so that the first connector assembly and the second connector assembly are unlocked.

In some embodiments, in a self-locked state of the first connector assembly and the second connector assembly, the split ring is in its initial state, and that in an unlocked state of the first connector assembly and the second connector assembly, the split ring is in its expanded state.

In some embodiments, the split ring has the protrusion on its inner circumferential surface, and the housing of the second connector assembly has the stop groove.

In some embodiments, the split ring presents a substantially hollow cylindrical shape.

In some embodiments, the first connector assembly has a sliding sleeve which is slidable on an outer circumferential surface of the second portion, wherein the sliding sleeve has an bevel capable of abutting against a radial inner edge of a front end surface of the split ring, and when the sliding sleeve slides axially backward relative to the housing of the first connector assembly, the bevel is capable of pressing the split ring radially outward, so that the protrusion leaves the stop groove.

In some embodiments, a front end portion of the sliding sleeve is configured to be hook-shaped, and has a transition portion extending radially inward and a spade portion extending axially rearward from an inner peripheral edge of the transition portion, wherein an outer circumferential surface of the spade portion forms the bevel.

In some embodiments, a front end portion of the split ring forms an abutment portion that extends linearly along an axial direction, wherein the abutment portion abuts against the bevel.

In some embodiments, the protrusion is at least partially disposed at a rear of the abutment portion.

In some embodiments, a front side surface and a rear side surface of the protrusion are configured to be inclined.

In some embodiments, the protrusion extends over an entire circumference of the split ring.

In some embodiments, the second portion has a base including a receiving groove, and a rear end portion of the split ring forms a bent portion, which is receivable in the receiving groove and movable radially in and out of the receiving groove freely.

In some embodiments, the second portion further has a flange extending axially forward from a front end surface of the base, and the split ring has a body portion located on a front side of the bent portion, wherein the body portion is capable of abutting against the flange by its portion axially overlapping with the flange.

In some embodiments, a rear end portion of the sliding sleeve is crimped radially inwardly so as to be inclined, thereby enabling to abutting against a rear edge of the second portion.

In some embodiments, the sliding sleeve has a support flange extending radially outward on its outer circumferential surface, and the support flange is configured to support the sliding sleeve when crimping a rear end portion of the sliding sleeve.

In some embodiments, a portion of an inner circumferential surface of the sliding sleeve adjoining a rear end portion forms a gap with the second portion.

In some embodiments, the sliding sleeve has a body portion extending axially, wherein the body portion is spaced apart from the split ring so that the body portion does not interfere with the split ring when the split ring expands.

In some embodiments, the housing of the first connector assembly has one of a positioning protrusion and a positioning groove extending along an axial direction, and the housing of the second connector assembly has the other of a positioning protrusion and a positioning groove extending along an axial direction, wherein the positioning protrusion is axially guidable in the positioning groove.

In some embodiments, a radial thickness of the flange is equal to a radial maximum height of the protrusion.

In some embodiments, the split ring has a plurality of slits extending a certain distance axially backward from its front end surface, wherein the distance is smaller than an axial length of the split ring, and one finger portion is formed between every two adjacent slits, respectively.

In some embodiments, the slits are uniformly distributed along a circumferential direction of the split ring.

In some embodiments, the distance is greater than half an axial length of the split ring.

In some embodiments, the stop groove is a circumferential groove enclosed along a circumferential direction.

In some embodiments, a cross-section of the stop groove is tapered in a direction toward its groove bottom.

In some embodiments, the housing of the second connector assembly has a body portion and a flange extending forward from a front end surface of the body portion, wherein the stop groove is disposed on the body portion.

In some embodiments, a diameter of an outer circumferential surface of the flange is smaller than a diameter of an outer circumferential surface of the body portion, thereby forming a stepped portion between the outer circumferential surface of the flange and the outer circumferential surface of the body portion.

In some embodiments, a stepped surface of the stepped portion is inclined.

In some embodiments, a diameter of a free end of the protrusion is equal to a diameter of the outer circumferential surface of the flange.

According to another aspect of the present invention, a cable connector assembly constructed as the first connector assembly of the cluster connector assembly system according to the present invention is provided.

According to another aspect of the present invention, a device connector assembly constructed as the second connector assembly of the cluster connector assembly system according to the present invention is provided.

In some embodiments, the second connector assembly further has threads configured for threaded connection with a connector assembly having corresponding threads.

According to another aspect of the present invention, a method for assembling the cluster connector assembly system according to the present invention is provided, the method comprising pushing the first connector assembly and the second connector assembly toward each other until the protrusion enters the stop groove based on own elastic force of the split ring, thereby implementing self-locking the first connector assembly and the second connector assembly.

According to another aspect of the present invention, a method for disassembling the cluster connector assembly system according to the present invention is provided, the method comprising: in the state where the first connector assembly and the second connector assembly are self-locked, sliding the sliding sleeve backward relative to the housing of the first connector assembly, so that the protrusion leaves the stop groove, thereby implementing unlocking the first connector assembly and the second connector assembly; and continuing pulling the first connector assembly and the second connector assembly so that they are disengaged from each other.

According to a further aspect of the present invention, a cluster connector assembly system is provided, wherein the cluster connector assembly system comprises a first connector assembly and a second connector assembly. The first connector assembly has a housing having a first portion configured to integrate a plurality of first connectors together and having a second portion located radially outward of the first portion, wherein a split ring and a plurality of balls are axially constrainedly arranged on the second portion relative to the housing, the split ring is elastically expandable and contractible in a radial direction, and the balls are circumferentially distributed so as to be arranged on the same radial side of the split ring. The second connector assembly has a housing configured to integrate a plurality of second connectors together, wherein the housing of the second connector assembly has a stop groove. The first connector assembly and the second connector assembly are engageable and disengageable in a push-pull manner, wherein, in a state where the first connector assembly is engaged with the second connector assembly, when a pressure is applied to the balls so that the balls radially press and drive the split ring, the split ring overcomes its own elastic force to partially enter the stop slot, thereby establishing self-locking of the first connector assembly and the second connector assembly.

In some embodiments, when the pressure is cancelled, the split ring moves away from the stop groove and drives the balls based on its own elastic force, so that the first connector assembly and the second connector assembly are unlocked.

In some embodiments, the balls are circumferentially distributed so as to be arranged radially outward of the split ring, such that the split ring enters a contracted state when the pressure is applied to the balls so that the balls radially inwards press and drive the split ring, and the split ring enters a released state when the pressure is canceled.

In some embodiments, the first connector assembly has a sliding sleeve which is slidable on an outer circumferential surface of the second portion, wherein the sliding sleeve has a release groove on an inner circumferential surface thereof, such that the pressure is cancelled when the sliding of the sliding sleeve causes the release groove to reach above the balls, and the inner circumferential surface of the sliding sleeve is capable of applying the pressure to the balls when the sliding of the sliding sleeve causes the release groove to leave above the balls.

In some embodiments, the second portion has a base and a flange extending axially forward from the base, and the stop groove is opened toward an inner circumferential surface of the flange in a state where the first connector assembly is engaged with the second connector assembly.

In some embodiments, the flange has a receiving groove extending circumferentially on its inner circumferential surface, and that the receiving groove is configured to receive the split ring.

In some embodiments, a radial depth of the receiving groove is equal to or greater than a radial height of the split ring.

In some embodiments, the flange has a plurality of receiving cavities for receiving the balls, and the receiving cavities are distributed circumferentially so as to be arranged radially outwards of the receiving groove.

In some embodiments, the receiving cavities communicate with the receiving groove in a radially inward direction and are opened radially outward.

In some embodiments, each receiving cavity is sized so that one ball can be completely submerged in the receiving cavity.

In some embodiments, a depth of the release groove is less than a radius of each ball.

In some embodiments, the release groove and/or the receiving groove are/is an annular groove(s) enclosed circumferentially.

In some embodiments, a stop ring is provided between the base and the sliding sleeve, and the stop ring is configured to define an axial sliding stroke of the sliding sleeve.

In some embodiments, a portion of the stop ring is received in a driving groove provided in an inner circumferential surface of the sliding sleeve, and the other portion of the stop ring is received in a sliding groove provided in an outer circumferential surface of the base.

In some embodiments, an axial width of the driving groove is equal to an axial width of the stop ring, and an axial width of the slide groove is greater than an axial width of the stop ring.

In some embodiments, a maximum value of the axial sliding stroke is designed such that the release groove is able to reach above the balls and leave above the balls.

In some embodiments, the stop ring has a square cross-section.

In some embodiments, the stop ring is constructed as another split ring.

In some embodiments, the sliding groove has a deeper section than other sections of the sliding groove, such that the deeper section has a radial depth designed to be greater than or equal to a radial height of the stop ring.

In some embodiments, the flange has a step portion on an outer circumferential surface thereof, and a front side wall of the release groove is capable of abutting against the step portion.

In some embodiments, the sliding sleeve has a structure on an outer circumferential surface thereof which is convenient for an operator to hold.

In some embodiments, the split ring has a circular or trapezoidal cross-section.

In some embodiments, the stop groove is a circumferential groove enclosed along a circumferential direction.

In some embodiments, a cross-section of the stop groove is tapered in a direction toward its groove bottom.

According to another aspect of the present invention, a cable connector assembly constructed as the first connector assembly of the cluster connector assembly system according to the present invention is provided.

According to another aspect of the present invention, a device connector assembly constructed as the second connector assembly of the cluster connector assembly system according to the present invention is provided.

In some embodiments, the second connector assembly further has threads configured for threaded connection with a connector assembly having corresponding threads.

According to another aspect of the present invention, a method for assembling the cluster connector assembly system according to the present invention is provided, the method comprising: sliding the sliding sleeve along a first direction, so that the release groove of the sliding sleeve reaches above the balls, thereby allowing the balls to partially enter the release groove so that the split ring enters the released state; pushing the first connector assembly and the second connector assembly toward each other so that they are engaged with each other, and at the same time the split ring reaches above the stop groove; and sliding the sliding sleeve in a second direction opposite to the first direction, so that the release groove of the sliding sleeve leaves above the ball, thereby allowing the split ring to enter the contracted state, and thus implementing self-locking the first connector assembly and the second connector assembly.

According to another aspect of the present invention, a method for disassembling the cluster connector assembly system according to the present invention is provided, the method comprising: in the self-locked state of the first connector assembly and the second connector assembly, sliding the sliding sleeve so that the release groove of the sliding sleeve reaches above the balls, thereby allowing the balls to partially enter the release groove so that the split ring enters the released state, and thus implementing unlocking the first connector assembly and the second connector assembly; and pulling the first connector assembly and the second connector assembly away from each other so that they are disengaged from each other.

It is to be noted that, various aspects of the present disclosure described with respect to one embodiment may be incorporated into other different embodiments, although not specifically described with respect to the other different embodiments. In other words, all embodiments and/or features of any embodiment may be combined in any manner and/or combination, as long as they are not contradictory to one another.

BRIEF DESCRIPTION OF THE DRAWINGS

After reading the embodiments hereinafter in conjunction with the accompanying drawings, a plurality of aspects of the present disclosure will be better understood. In the accompanying drawings.

It should be understood that, in all the accompanying drawings, the same reference signs present the same elements. In the drawings, for the sake of clarity, the sizes of certain features may be altered rather than being delineated to scale.

DETAILED EMBODIMENTS

Figure 1:
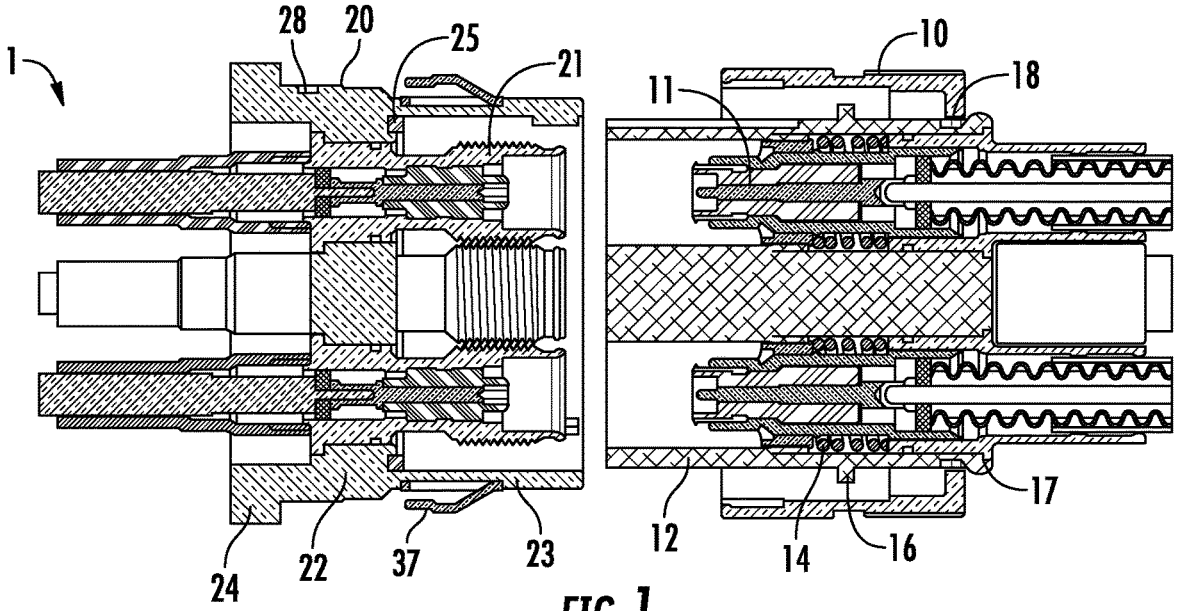
FIG. 1 is a cross-sectional view of a coaxial connector assembly according to a first embodiment of the present disclosure.
Figure 2:
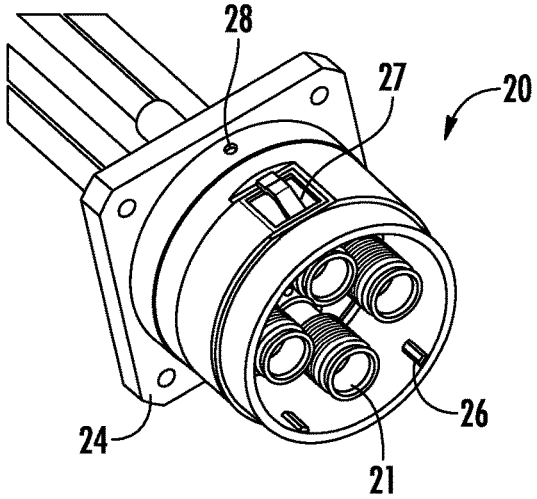
FIG. 2 is a perspective view of a female connector of the coaxial connector assembly shown in FIG. 1.
Figure 3:
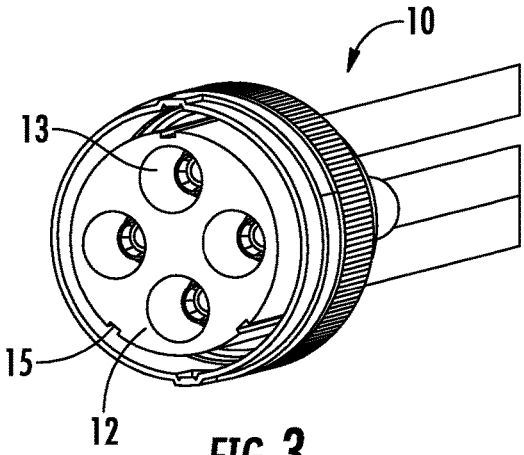
FIG. 3 is a perspective view of a male connector of the coaxial connector assembly shown in FIG. 1.

The present disclosure will be described below with reference to the accompanying drawings, in which several embodiments of the present disclosure are shown. It should be understood, however, that the present disclosure may be presented in multiple different ways, and not limited to the embodiments described below. In fact, the embodiments described hereinafter are intended to make a more complete disclosure of the present disclosure and to adequately explain the protection scope of the present disclosure to a person skilled in the art. It should also be understood that, the embodiments disclosed herein can be combined in various ways to provide more additional embodiments.

It should be understood that, the wording in the specification is only used for describing particular embodiments and is not intended to define the present disclosure. All the terms used in the specification (including the technical terms and scientific terms), have the meanings as normally understood by a person skilled in the art, unless otherwise defined. For the sake of conciseness and/or clarity, the well-known functions or constructions may not be described in detail any longer.

The singular forms "a/an", "said" and "the" as used in the specification, unless clearly indicated, all contain the plural forms. The wordings "comprising", "containing" and "including" used in the specification indicate the presence of the claimed features, but do not repel the presence of one or more other features. The wording "and/or" as used in the specification includes any and all combinations of one or more of the relevant items listed.

The phases "between X and Y" and "between about X and Y" as used in the specification should be construed as including X and Y. The phrase "between about X and Y" as used in the present specification means "between about X and about Y", and the phrase "from about X to Y" as used in the present specification means "from about X to about Y".

In the specification, when one element is referred to as being "on" another element, "attached to" another element, "connected to" another element, "coupled to" another element, or "in contact with" another element, the element may be directly located on another element, attached to another element, connected to another element, coupled to another element, or in contact with another element, or there may be present with an intermediate element.

In the specification, the terms "first", "second", or "third" is used for convenient description only but not intended to be restrictive. Any technical features represented by "first", "second" or "third" are interchangeable.

In the specification, the spatial relation wordings such as "up", "down", "forth", "back", "top", "bottom" and the like may describe a relation of one feature with another feature in the drawings. It should be understood that, the spatial relation wordings also contain different orientations of the apparatus in use or operation, in addition to containing the orientations shown in the drawings. For example, when the apparatus in the drawings is overturned, the features previously described as "below" other features may be described to be "above" other features at this time. The apparatus may also be otherwise oriented (rotated 90 degrees or at other orientations). At this time, the relative spatial relations will be explained correspondingly.

In this specification, the ends of the male connector and the female connector that are facing each other when mated are defined as proximal ends, and the ends distant from each other are defined as distal ends. In addition, in this specification, the term "pressing down" means pressing toward the male connector or the female connector along a radial direction.

The present disclosure relates to a coaxial connector assembly, particularly a ganged coaxial connector assembly, which may include a male connector and a female connector. The male connector is usually terminated with a cable such as an electric cable or an optical cable, while the female connector is usually installed on a device such as a base station antenna or a remote radio unit or terminated with another cable such as an electric cable or an optical cable. The outer peripheries of the male connector and the female connector are provided with a lateral locking mechanism. When the male connector and the female connector are connected to each other, the locking mechanism may quickly lock and unlock a connection between the male connector and the female connector in a "push-pull" manner, and may ensure a favorable and stable dynamic intermodulation performance of the coaxial connector assembly. The coaxial connector assembly according to the present disclosure will be described in detail below with reference to the accompanying drawings.

Referring to FIGS. 1 to 5, a coaxial connector assembly 1 according to a first embodiment of the present disclosure, which includes a male connector 10 and a female connector 20, is shown. The male connector 10 may include one or more male connector elements 11, and the female connector 20 may include one or more female connector elements 21 in a same number of the male connector elements 11 and adapted to be mated with the corresponding male connector elements 11, thereby enabling the male connector 10 and the female connector 20 to be connectable to each other. In the embodiment shown in FIGS. 1, 2*a* and 2*b*, the coaxial connector assembly 1 is constructed as a ganged coaxial connector assembly, wherein the male connector 10 is provided with four male connector elements 11, and the female connector 20 is provided with four female connector elements 21. However, the present disclosure is not limited to this. The male connector 10 and the female connector 20 may respectively include other numbers of male connector elements and female connector elements, such as 1, 2, 3, 5, etc. In the embodiment according to the present disclosure, the male connector element and the female connector element may include various types of connector interfaces, such as 4.3-10 connector interface, 2.2-5 connector interface, DIN connector interface, NEX10 connector interface, SMA connector interface, N-type connector interface, 7/16 RF connector interface and the like.

The male connector 10 may include a cylindrical body 12 provided with one or more through holes 13. The one or more male connector elements 11 may be respectively received in corresponding through holes 13. In the embodiment shown in FIG. 2*b*, each male connector element 11 may be accommodated in a corresponding through hole 13 floatable axially by means of an elastic member 14. The elastic member 14 may be a helical spring, a leaf spring or other suitable elastic member. In other embodiments according to the present disclosure, the male connector elements 11 may also be fixedly arranged in corresponding through holes 13 by means of interference fit, threaded connection, welding and the like.

The female connector 20 may include a cylindrical body 22, an annular protrusion 23 located at a proximal end of the body 22, and a fixing panel 24 located at a distal end of the body 22. The one or more female connector elements 21 may be arranged in the body 22 in various ways. For example, each female connector element 21 may be directly inserted into a through hole provided in the body 22 in an interference fit, or may be fixed in the through hole of the body 22 by threaded connection, welding, or the like. The annular protrusion 23 surrounds the one or more female connector units 21 and receives the body 12 of the male connector 10 when the male connector 10 and the female connector 20 are connected to each other. A sealing element 25 is provided at an inside end of the annular protrusion 23 proximate to the body 22. When the body 12 of the male connector 10 is inserted into the annular protrusion 23 of the female connector 20, the sealing element 25 is used to seal a gap between the body 12 of the male connector 10 and the body 22 of the female connector 20, thereby preventing water, dust or the like from entering the inside of the coaxial connector assembly 1 via the gap. The sealing element 25 may be a sealing ring with a rectangular interface, or an "O"-shaped sealing ring with a circular interface. The fixing panel 24 is configured to fix the female connector 20 to other devices or members, which may be in a square, rectangular, or any other suitable shape.

When the coaxial connector assembly 1 is constructed as a ganged coaxial connector assembly, the female connector 20 may further include positioning elements, and the male connector 10 may include mating elements for mating with the positioning elements. By means of the cooperation of the positioning elements of the female connector 20 and the mating elements of the male connector 10, each male connector element of the male connector 10 can be correctly inserted into a corresponding female connector element of the female connector 20. This is particularly useful to ensure one by one correspondence of different line channels once the male connector 10 and the female connector 20 are connected, and to prevent a relative rotation between the male connector element and the female connector. In the embodiment shown in FIGS. 1 and 2, the positioning elements are constructed as a plurality of (for example, three) ribs 26 located on the inner surface of the annular protrusion 23, wherein the ribs 26 are spaced apart from each other at uneven distances along a circumferential direction of the annular protrusion 23. Correspondingly, an outer periphery of the body of the male connector 10 is provided with a plurality of grooves 15 for receiving each of the plurality of ribs. Similarly, the plurality of grooves 15 are also spaced apart from each other at uneven distances along a circumferential direction. By spacing the plurality of ribs 26 and the plurality of grooves 15 apart from each other by uneven distances, it may be ensured that the male connector elements are insertable into the female connector elements only when the plurality of ribs 26 and the plurality of grooves 15 are correctly positioned, thereby preventing a false connection between the male connector elements and the female connector elements. In other embodiments according to the present disclosure, the female connector 10 may further include a guide post positioned among the plurality of female connector elements 11 to facilitate guiding the insertion of the male connector 10. Correspondingly, the male connector 10 may include a guide hole for accommodating the guide post. The guide post may have different configurations, such as a cylinder, a triangular prism, a quadrangular prism, a pentagonal prism, or the like.

In one embodiment according to the present disclosure, in order to easily align the male connector 10 and the female connector 20, indicator marks 18 and 28 may be provided on the body 12 of the male connector 10 and the body 22 of the female connector 20 respectively (as shown in FIG. 1). When inserting the male connector 10 into the female connector 20, the operator may align the male connector 10 and the female connector 20 by aligning the indicator marks 18 and 28. The indicator marks 18 and 28 may be recesses, protrusions, or any other forms of marks provided on the male connector 10 and the female connector 20. In order to make the indicator marks 18 and 28 more conspicuous, the indicator marks 18 and 28 may be formed as colored marks (such as red, yellow, green marks and the like).

The coaxial connector assembly 1 according to the present disclosure further includes a locking mechanism. The locking mechanism may include a first locking member 30 and a second locking member 40 adapted to lock and unlock each other. The first locking member 30 may include at least one elastic snap-fit element, and the second locking member 40 may include a locking element adapted to engage with the at least one elastic snap-fit element in a snap-fit manner. The first locking member 30 may be disposed on an outer periphery of one of the male connector and the female connector, and the second locking member 40 may be disposed on an outer periphery of the other of the male connector and the female connector.

Figure 4:
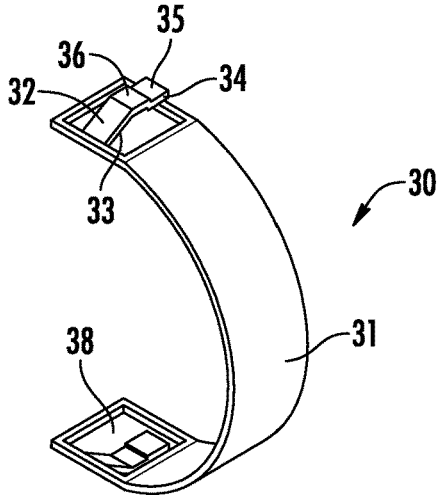
FIG. 4 is a perspective view of a first locking member of the locking mechanism according to the first embodiment of the present disclosure.

Referring to FIG. 4, a specific structure of the first locking member 30 of the locking mechanism according to the first embodiment of the present disclosure is shown. The first locking member 30 may include a semicircular body 31 and two elastic snap-fit elements 32 arranged at opposite ends of the body 31 and spaced apart by about 180°. Each elastic snap-fit element 32 is constructed as a cantilever with one end fixed on the body 31, and includes an inclined section 33 extending obliquely radially outwards from one side of the body 31 to the other side of the body 31 and a substantially horizontal section 34 extending axially above the body 31 from the inclined section further toward the other side of the body 31. In other words, each elastic snap-fit element 32 is substantially formed on the radially outward side of the body 31 and faces the body 31 in a cantilevered manner. With such a structure, on the one hand, an axial width of the first locking member 30 is made narrower, thereby occupying a smaller installation space; on the other hand, each elastic snap-fit element 32 can move between an unlocking position and a locking position along a radial direction. In the unlocking position, the elastic snap-fit element 32 is pressed down, so that the elastic snap-fit element 32 can be disengaged from a locking element of the second locking member 40 to unlock a connection between the male connector 10 and the female connector 20. In the locking position, the elastic snap-fit element 32 springs back to its initial state, so that the elastic snap-fit element 32 can engage with the locking element of the second locking member 40 to lock a connection between the male connector 10 and the female connector 20. In the embodiment shown in FIG. 4, the horizontal section 34 of each elastic snap-fit element 32 may be constructed in a stepped shape, which includes a depressed portion 35, a raised portion 36 raised relative to the depressed portion 35, and a stepped surface 37 formed between the depressed portion 35 and the raised portion 36. The depressed portion 35, the raised portion 36 and the stepped surface 37 cooperate with the locking element of the second locking member 40 to achieve locking, which will be described later.

Figure 5:
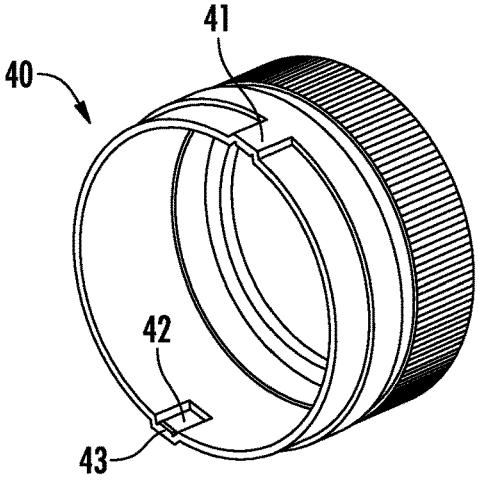
FIG. 5 is a perspective view of a second locking member of the locking mechanism according to the first embodiment of the present disclosure.

Referring to FIG. 5, a specific structure of the second locking member 40 of the locking mechanism according to the first embodiment of the present disclosure is shown. The second locking member 40 may be constructed as a locking sleeve. The inner surface of the locking sleeve is provided with two locking elements 41 spaced apart by approximately 180°. Each locking element 41 may include a depressed portion 42 and a stop portion 43 located at a proximal end of the depressed portion 42. The stop portion 43 may be constructed as a flange extending radially inward. In the locking position, the raised portion 36 of the elastic snap-fit element 32 will be received in the depressed portion 42 of the locking element 41 and the stepped surface 37 of the elastic snap-fit element 32 abuts against the stop portion 43 of the locking element 41, thereby blocking the raised portion 36 of the elastic snap-fit element 32 from moving out of the depressed portion 42 along an axial direction with the aid of cooperation of the stepped surface 37 and the stop portion 43. In addition, in the locking position, at least a portion of the depressed portion 35 of the elastic snap-fit element 32 projects from the second locking member 40, which provides a force application position during the unlocking process.

In other embodiments according to the present disclosure, the elastic snap-fit member 32 of the first locking member 30 and the locking member 41 of the second locking member 40 may have other configurations. For example, the outer surface of the horizontal section 34 of the elastic snap-fit element 32 of the first locking member 30 may be provided with a raised portion (such as a rectangular rib, a raised cylinder, a hemispherical protrusion, etc.), while the locking element 41 of the second locking member 40 may be constructed as a depressed portion (for example, a groove, a round hole, etc.) for receiving the raised portion of the elastic snap-fit element 32. Alternatively, the locking element 41 of the second locking member 40 may be constructed as a raised portion (such as a rectangular rib, a raised cylinder, a hemispherical protrusion, etc.), and the outer surface of the horizontal section 34 of the elastic snap-fit element 32 of the first locking member 30 may be provided with a depressed portion (for example, a groove, a round hole, etc.), as long as the elastic snap-fit element 32 and the locking element 41 can be locked.

Returning to FIGS. 1 to 3, in the embodiment according to the present disclosure, the first locking member 30 is fixedly mounted on an outer periphery of the female connector 20, and the elastic snap-fit element 32 is positioned such that its free end is toward the distal end of the female connector 20, that is, the elastic snap-fit element 32 is positioned to extend toward a direction remote from the male connector 10. The first locking member 30 may be fixed on an outer periphery of the female connector 20 in a buckle connection. To this end, both ends of the body 31 of the first locking member 30 may be provided with openings 38, each of which may be buckled on the raised portion 27 provided on the outer periphery of the female connector 20, thereby fixedly mounting the first locking member 30 on the female connector 20. The opening 38 may be a rectangular opening. Correspondingly, the raised portion 27 may have a rectangular outer feature. The first locking member 30 may also be fixed on the outer periphery of the female connector 20 by other members such as pins and screws.

The second locking member 40 is axially slidably mounted on an outer periphery of the male connector 10. For this reason, two annular bosses 16 and 17 spaced apart by a certain distance are provided on the outer periphery of the male connector 10. The second locking member 40 may axially slide between the annular bosses 16 and 17 to lock or unlock with the first locking member 30.

Figure 6A:
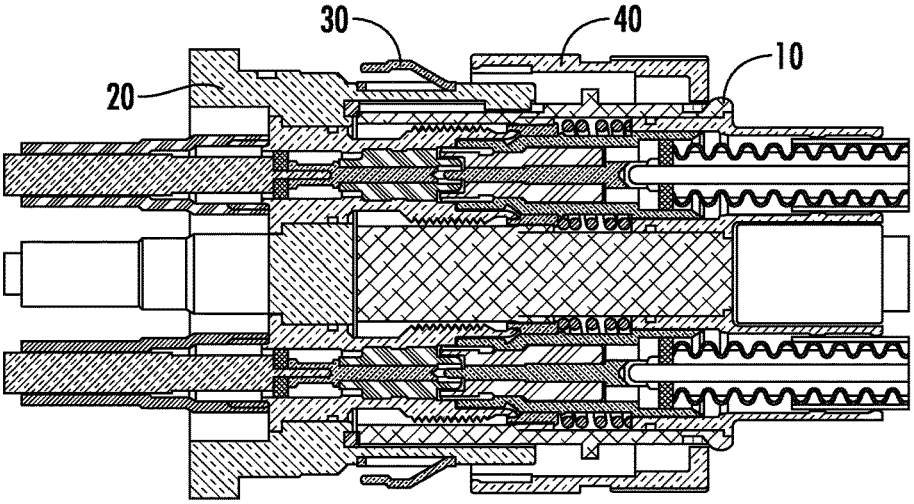
FIGS. 6*a* to 6*d* are schematic views of locking and unlocking the coaxial connector assembly according to the first embodiment of the present disclosure.
Figure 6B:
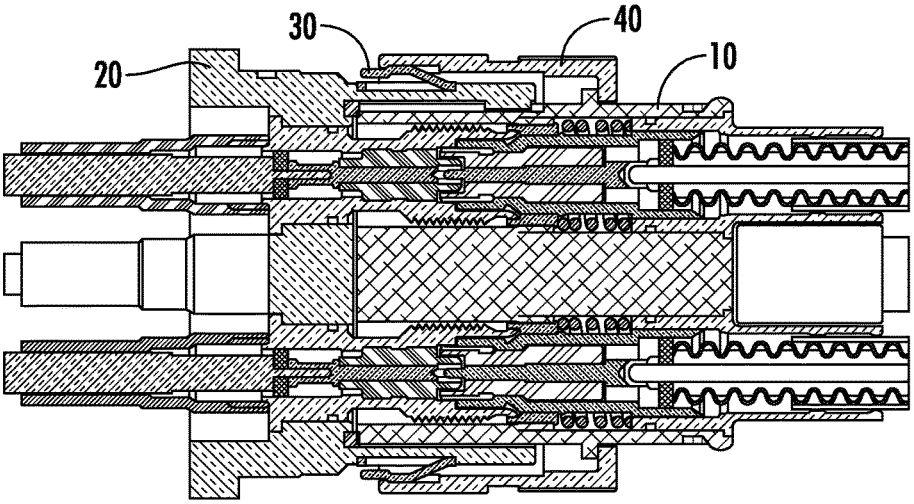
Figure 6C:
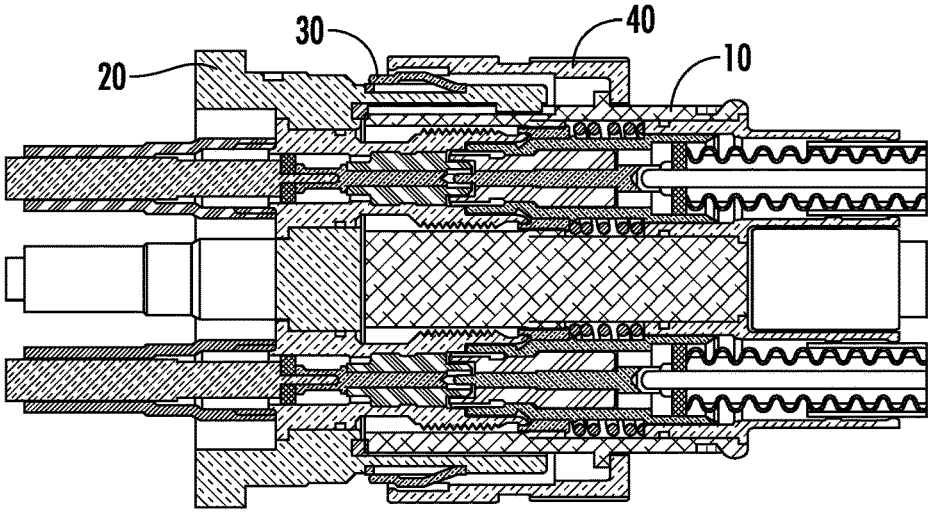
Figure 6D:
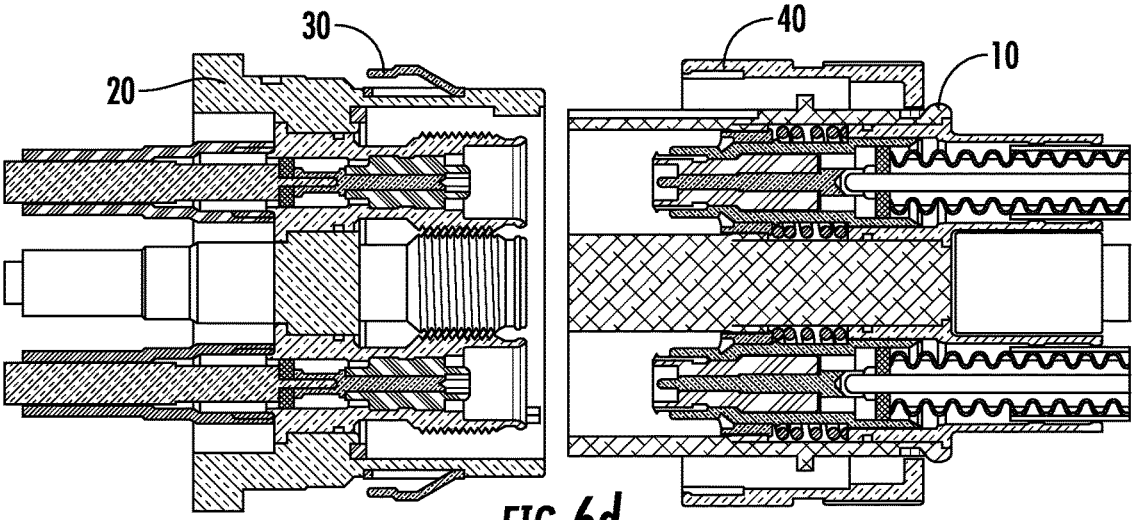
Figure 7:
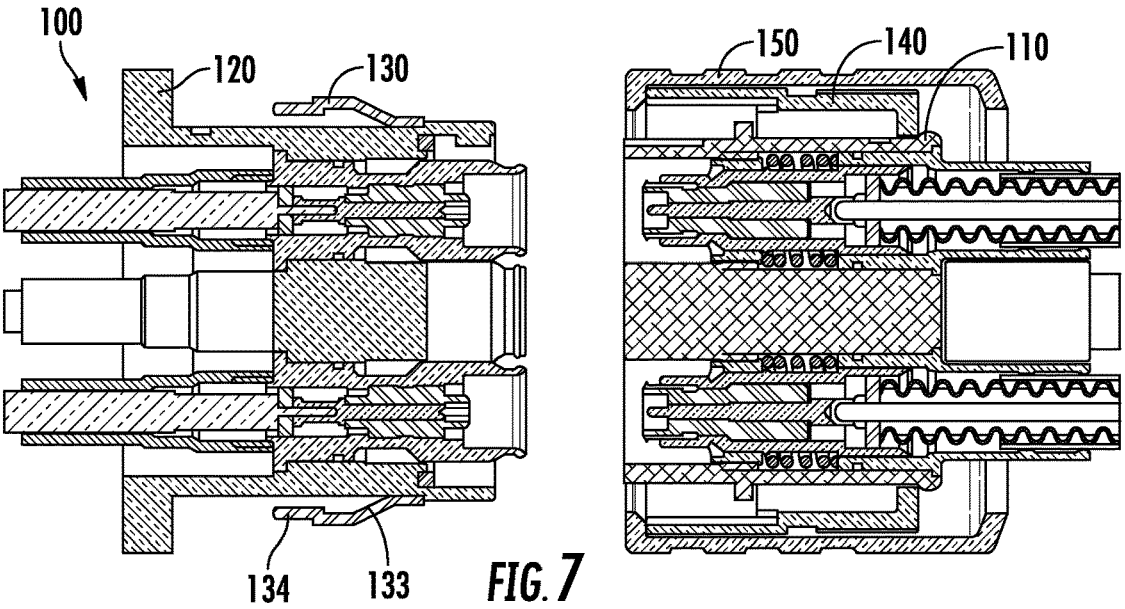
FIG. 7 is a cross-sectional view of a coaxial connector assembly according to a second embodiment of the present disclosure.
Figure 8A:
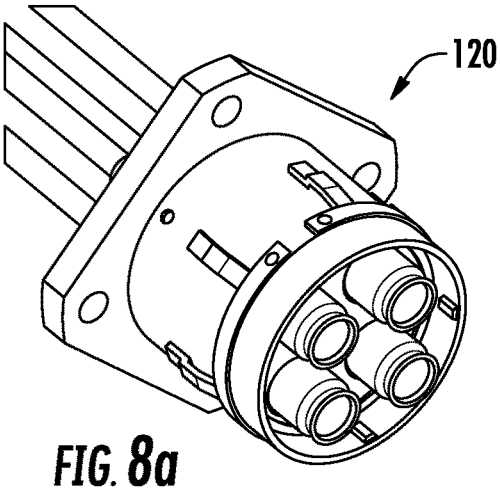
FIGS. 8*a* and 8*b* are respectively perspective views of the female connector and the male connector of the coaxial connector assembly shown in FIG. 7.
Figure 8B:
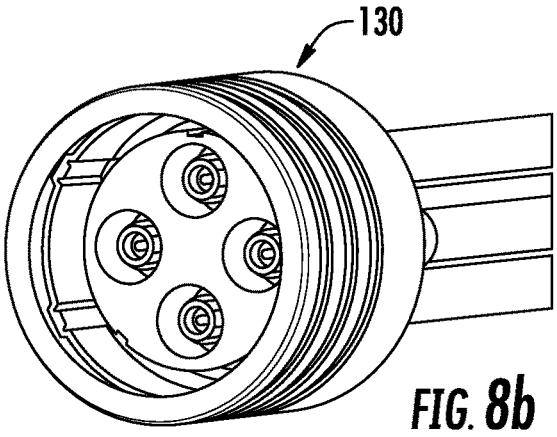

Next, a method of locking and unlocking the connection between the male connector 10 and the female connector 20 of the coaxial connector assembly 1 will be described with reference to FIGS. 6*a* to 6*d*. During the locking process, the male connector 10 is first inserted into the female connector 20 aligned with the later (reference may be made to the indicator marks 18 and 28); then the second locking member 40 is pushed axially along a direction toward the female connector 20, so that the front end of the second locking member 40 abuts against the inclined section 33 of the elastic snap-fit member 32 of the first locking member 30 and thereby presses down the elastic snap-fit member 32; the second locking member 40 is pushed continuously to cause the horizontal section 34 of the elastic snap-fit element 32 of the first locking member 30 to enter the second locking member 40 and further cause the raised portion 36 of the horizontal section 34 of the elastic snap-fit element 32 to spring back into the depressed portion 42 of the locking element 41 of the second locking element 40. At this time, the stepped surface 37 of the elastic snap-fit element 32 can abut against the stop portion 43 of the locking element 41, so that the first locking member 30 and the second locking member 40 are snap-fitly engaged to lock the connection between the male connector 10 and the female connector 20 (as shown in FIG. 6*b*). During the unlocking process, the portions of the two elastic snap-fit elements 32 of the first locking member 30 that project from the second locking member 40 may be pressed down simultaneously by two fingers of one hand, so that the raised portion 36 of the elastic snap-fit element 32 is removed from the depressed portion 42 of the locking element 41 of the second locking member 40 (as shown in FIG. 6*c*). Then, the second locking member 40 is axially pulled along a direction toward the male connector 20 until it is completely separated from the first locking member 30. At this time, the connection between the male connector 10 and the female connector 20 is unlocked. After that, it is also possible to continue pulling the second locking member 40 to completely separate the male connector 10 from the female connector 20.

The coaxial connector assembly 1 according to the first embodiment of the present disclosure is described above with reference to FIGS. 1 to 6*d*. However, the present disclosure is not limited to the above-mentioned embodiment. In other embodiments according to the present disclosure, the first locking member 30 may not include the body 31. In these embodiments, the two elastic snap-fit elements 32 of the first locking member 30 may be directly fixed on the outer periphery of the female connector 20 (for example, one end of each elastic snap-fit element 32 may be directly fixed on the outer periphery of the female connector 20 by a pin or a screw) in a manner that the two elastic snap-fit elements 32 of the first locking member 30 are opposite to each other along a diameter direction (i.e., spaced apart by about 180°). In addition, the second locking member 40 may be fixedly mounted on the outer periphery of the male connector 10. At this time, the second locking member 40 will move synchronously with the male connector 10, so that the locking or unlocking of the first locking member 30 and the second locking member 40 is performed synchronously with the connection or disconnection of the male connector 10 and the female connector 20, which may lock and unlock a connection of the male connector 10 and the female connector 20 more quickly.

Referring to FIGS. 7 to 10*b*, a coaxial connector assembly 100 according to the second embodiment of the present disclosure is shown. The coaxial connector assembly 100 may include a male connector 110 and a female connector 120. The male connector 110 and the female connector 120 may have substantially the same construction as the male connector 10 and the female connector 20, which will not be described in detail here.

The coaxial connector assembly 100 may include a locking mechanism. The locking mechanism may include a first locking member 130 and a second locking member 140 adapted to lock and unlock each other, and may further include an unlocking member 150 for unlocking the first locking member 130 and the second locking member 140, which may allow more simple and quick unlocking of the first locking member 130 and the second locking member 140. The first locking member 130 may be disposed on an outer periphery of one of the male connector and the female connector, and the second locking member 140 may be provided on an outer periphery of the other of the male connector and the female connector.

Figure 9A:
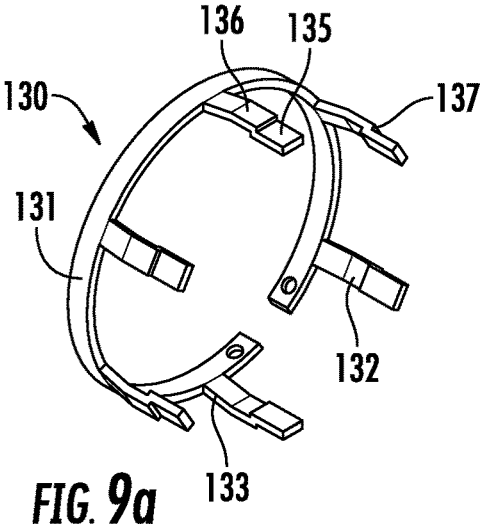
FIGS. 9*a* and 9*b* are respectively perspective views of a first locking member and a second locking member of the locking mechanism according to the second embodiment of the present disclosure.
Figure 9B:
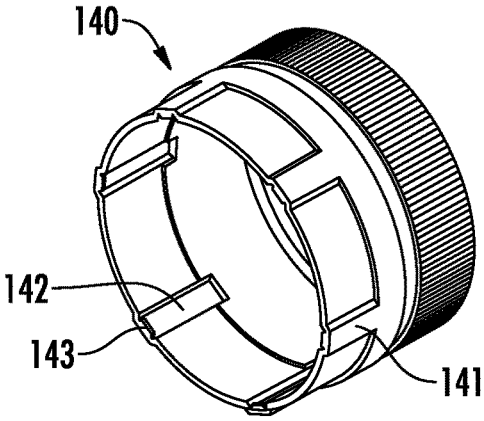

Referring to FIGS. 9*a* and 9*b*, specific structures of the first locking member 130 and the second locking member 140 of the locking mechanism according to the second embodiment of the present disclosure respectively are shown.

The first locking member 130 may include a substantially circular body 131 and a plurality of elastic snap-fit elements 132 disposed on the body 131 and substantially uniformly distributed along a circumferential direction of the body 131. The substantially circular body 131 may have a cutout, so that the body 131 may be expanded with the aid of the cutout, so as to facilitate mounting the first locking member 130 on the male connector 110 or the female connector 120. The body 131 may also form a complete circular body without a cutout. Each elastic snap-fit element 132 is constructed as a cantilever with one end fixed on the body 131, and includes an inclined section 133 extending obliquely outward from one side of the body 131 toward a direction remote from the body 131 and a substantially horizontal section 134 extend axially from the inclined section 133 further toward the direction remote from the body 131. The horizontal section 134 of each elastic snap-fit element 132 may be constructed in a stepped shape, which includes a depressed portion 135, a raised portion 136 raised relative to the depressed portion 135, and a stepped surface 137 formed between the depressed portion 135 and the raised portion 136. The depressed portion 135, the raised portion 136, and the stepped surface 137 cooperate with a locking element of the second locking member 140 to achieve locking. With the cantilever structure, each elastic snap-fit element 132 can move between an unlocking position and a locking position along a radial direction. In the unlocking position, the elastic snap-fit element 132 is pressed down so that the elastic snap-fit element 132 can be disengaged from the locking element of the second locking member 140 so as to unlock a connection between the male connector 100 and the female connector 200. In the locking position, the elastic snap-fit element 132 springs back to its initial state, so that the elastic snap-fit element 132 can be engaged with the locking element of the second locking member 140 so as to lock the connection of the male connector 100 and the female connector 200.

The second locking member 140 may be constructed as a locking sleeve. The inner surface of the locking sleeve is provided with a plurality of locking elements 141 uniformly distributed along a circumferential direction, wherein each locking element 141 is adapted to cooperate with one corresponding elastic snap-fit element 132. Each locking element 141 may include a depressed portion 142 and a stop portion 143 located at a proximal end of the depressed portion 142. The stop portion 143 may be constructed as a flange extending radially inward. In the locking position, the raised portion 136 of the elastic snap-fit element 132 will be received in the depressed portion 142 of the locking element 141 and the stepped surface 137 of the elastic snap-fit element 132 abuts against the stop portion 143 of the locking element 141, thereby blocking the raised portion 136 of the elastic snap-fit element 132 from moving out of the depressed portion 142 along an axial direction with the aid of cooperation of the stepped surface 137 with the stop portion 143. In addition, in the locking position, at least a portion of the depressed portion 135 of the elastic snap-fit element 132 projects from the second locking member 140, which provides a force application position during the unlocking process.

In other embodiments according to the present disclosure, the elastic snap-fit member 132 of the first locking member 130 and the locking member 141 of the second locking member 140 may have other configurations. For example, the outer surface of the horizontal section 134 of the elastic snap-fit element 132 of the first locking member 130 may be provided with a raised portion (such as a rectangular rib, a raised cylinder, a hemispherical protrusion, etc.), while the locking element 141 of the second locking member 140 may be constructed as a depressed portion (for example, a groove, a round hole, etc.) for receiving the raised portion of the elastic snap-fit element 132. Alternatively, the locking element 141 of the second locking member 140 may be constructed as a raised portion (such as a rectangular rib, a raised cylinder, a hemispherical protrusion, etc.), and the outer surface of the horizontal section 134 of the elastic snap-fit element 132 of the first locking member 130 may be provided with a depressed portion (for example, a groove, a round hole, etc.), as long as the elastic snap-fit element 132 and the locking element 141 can be locked.

Figure 10A:
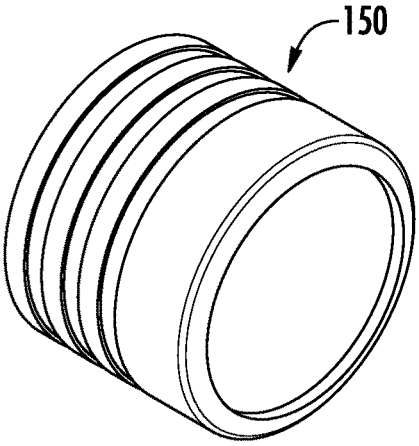
FIGS. 10*a* and 10*b* are respectively a perspective view and a cross-sectional view of an unlocking member of the locking mechanism according to the second embodiment of the present disclosure.
Figure 10B:
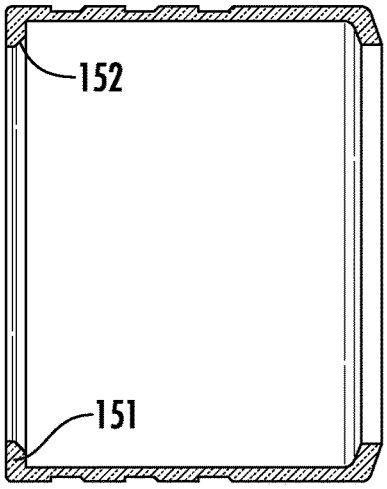
Figure 11A:
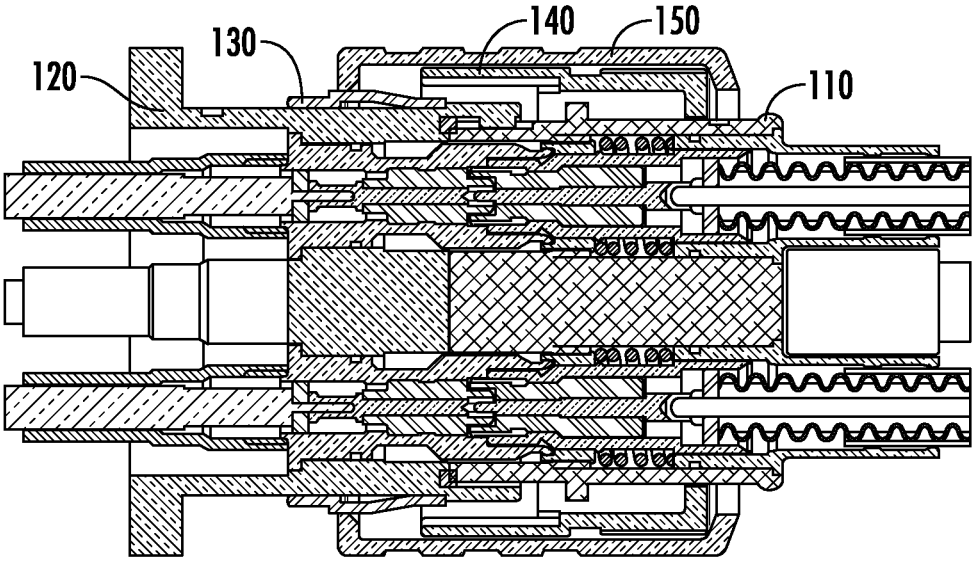
FIGS. 11*a* to 11*d* are schematic views of locking and unlocking the coaxial connector assembly according to the second embodiment of the present disclosure.
Figure 11B:
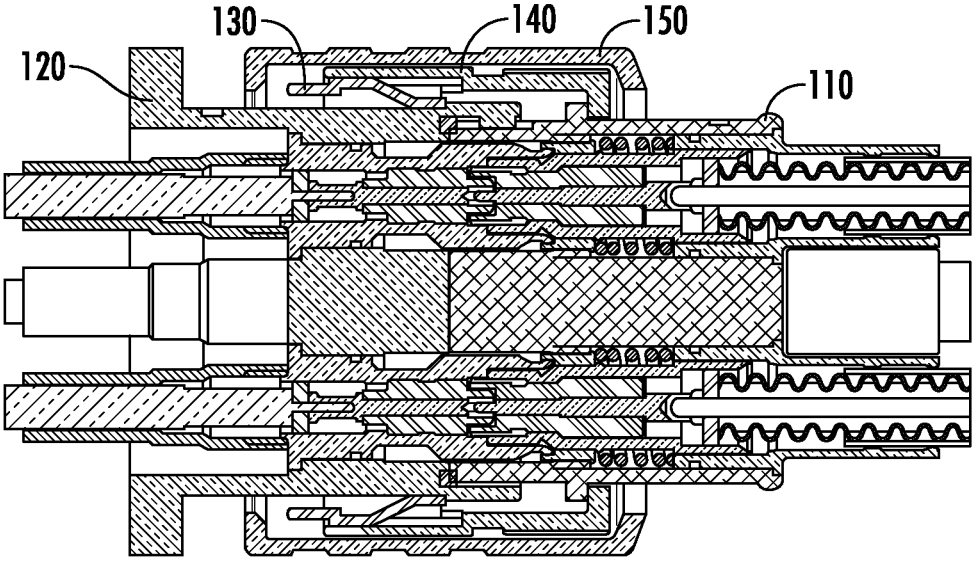
Figure 11C:
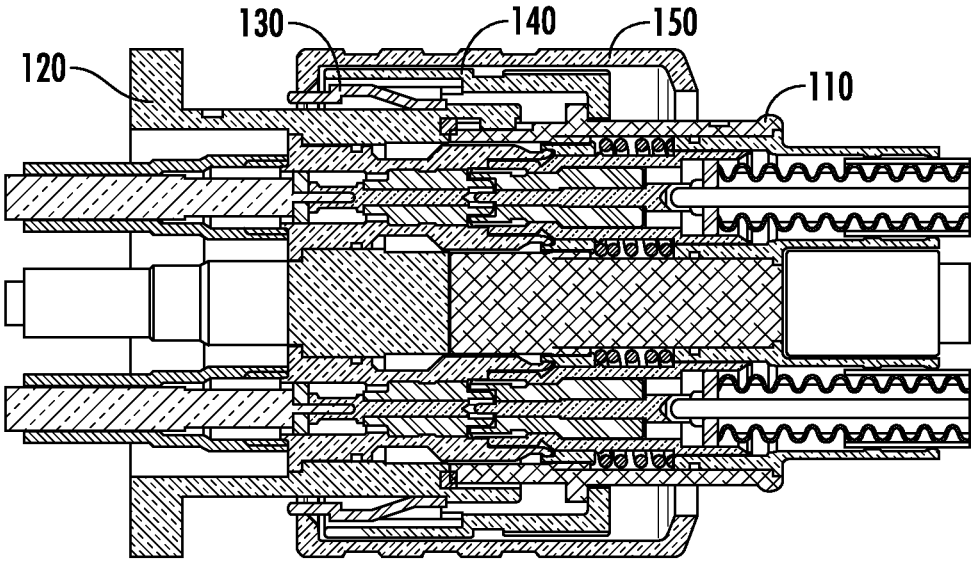
Figure 11D:
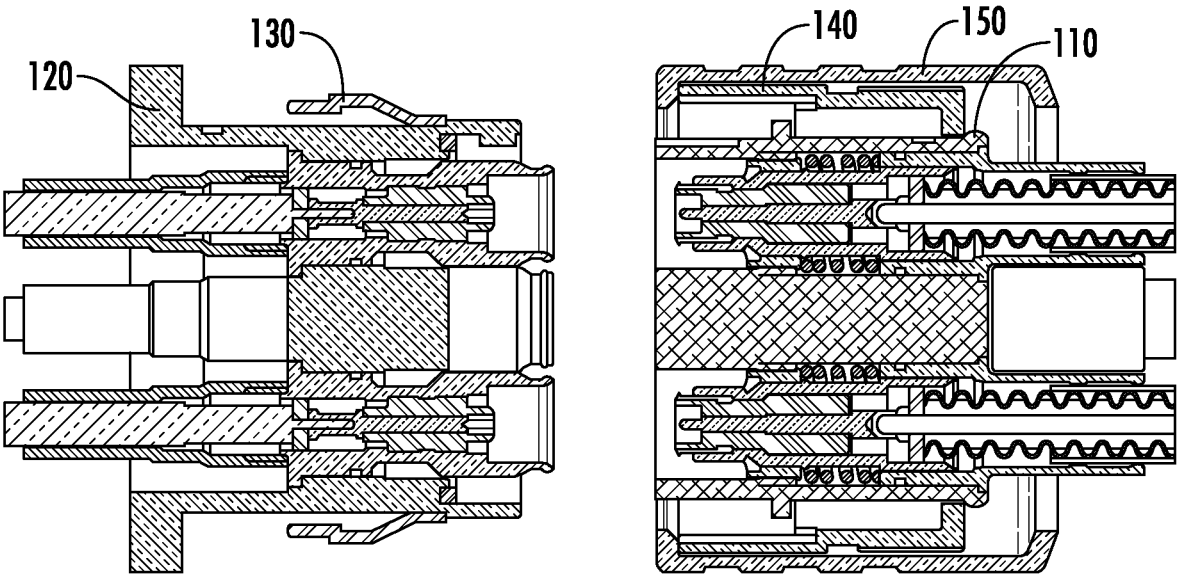

In order to facilitate that the plurality of elastic snap-fit elements 141 of the first locking member 130 are simultaneously pressed down to simply and quickly unlock the first locking member 130 and the second locking member 140, an unlocking member 150 is also provided. As shown in FIGS. 10*a* and 10*b*, the unlocking member 150 may be constructed as an unlocking sleeve. The proximal end of the unlocking sleeve is provided with an annular flange 151 extending radially inwards, which may simultaneously press down the portions of the plurality of elastic snap-fit elements 141 of the first locking member 130 that project from the second locking member 140, so that the elastic snap-fit elements 132 are moved to the unlocking position, that is, the raised portions 136 of the elastic snap-fit elements 132 are moved out of the depressed portions 142 of the locking elements 141 of the second locking member 140. The annular flange 151 may include an inclined surface 152 to facilitate pressing down the portions of the plurality of elastic snap-fit elements 141 that project from the second locking member 140.

In the embodiment according to the present disclosure, the first locking member 130 is fixedly mounted on the outer periphery of the female connector 120, and each elastic snap-fit element 132 is positioned such that its free end is toward the distal end of the female connector 120, that is, each elastic snap-fit element 132 is positioned to extend toward a direction remote from the male connector 110. The first locking member 130 may be fixed on the outer periphery of the female connector 120 by means of pins, screws and other members. Of course, the first locking member 130 may also be fixed on the outer periphery of the female connector 120 by a buckle connection similar to the first locking member 30. The second locking member 140 is axially slidably mounted on the outer periphery of the male connector 110. For this reason, two annular bosses 113 and 114 spaced apart by a certain distance are provided on the outer periphery of the male connector 110. The second locking member 140 may axially slide between the annular bosses 113 and 114 to lock or unlock with the first locking member 130. The unlocking member 150 is also axially slidably mounted on the outer periphery of the male connector 110 and surrounds the second locking member 140. When the unlocking member 150 slides, it may drive the second locking member 140 to slide together.

The method of locking and unlocking the connection between the male connector 110 and the female connector 120 of the coaxial connector assembly 100 will be described with reference to FIGS. 11*a* to 11*d*. During the locking process, the male connector 110 is first inserted into the female connector 120 aligned with the later; then the unlocking member 150 is pushed axially along a direction toward the female connector 120, so that its annular flange 151 will abut against the inclined section 133 of the elastic snap-fit element 132 of the first locking member 130 and thereby press down the elastic snap-fit element 132; the unlocking member 150 is continuously pushed, which will drive the second locking member 140 to move together along a direction toward the female connector 120, so that the horizontal section 134 of the elastic snap-fit element 132 of the first locking member 130 enters the second locking member 140 and further makes the raised portion 136 of the horizontal section 134 of the elastic snap-fit element 132 spring back into the depressed portion 142 of the locking element 141 of the second locking element 140. At this time, the stepped surface 137 of the elastic snap-fit element 132 may abut against the stop portion 143 of the locking element 141, so that the first locking member 130 and the second locking member 140 are snap-fitly engaged to lock a connection between the male connector 110 and the female connector 120 (as shown in FIG. 6*b*). During the unlocking process, the unlocking member 150 is pulled axially along a direction toward the male connector 120, so that the annular flange 151 of the unlocking member 150 simultaneously presses down the portions of the plurality of elastic snap-fit elements 132 of the first locking member 130 that project from the second locking member 140, so that the raised portion 136 of each elastic snap-fit member 132 move out of the depressed portion 142 of the locking member 141 of the second locking member 140 (as shown in FIG. 611*c*); the unlocking member 150 is continuously pulled, which will drive the second locking member 140 to move together along the direction toward the male connector 110 until the second locking member 140 is completely separated from the first locking member 130. At this time, the connection between the male connector 110 and the female connector 120 is unlocked. After that, it is also possible to continue pulling the unlocking member 150 to completely separate the male connector 110 from the female connector 120. The unlocking member 150 may make it possible to more simply and quickly lock and unlock the first locking member 130 and the second locking member 140, since it suffices by only pushing or pulling the unlocking member 150 along an axial direction.

In embodiments according to the present disclosure, each member of the locking mechanism may be constructed as a metal member or an injection molded member. The locking mechanism according to the present disclosure not only allows for simply and quickly locking and unlocking the connection between the male connector and the female connector of the coaxial connector assembly, but also can ensure the stability of the dynamic intermodulation performance thereof. In addition, such a design of the elastic snap-fit element and the unlocking sleeve not only allows the locking mechanism to be easily manufactured, but also improves the tensile strength of the locking mechanism.

Referring now to FIGS. 12-15*d*, another cluster connector assembly is shown therein and designated broadly at 201. The cluster connector assembly system 201 of the present invention may include a cable connector assembly 202 and a device connector assembly 203, both of which may be engaged and disengaged in a push-pull manner, and may be easily self-locked and unlocked. The device using the device connector assembly 203 may be, for example, a base station antenna, a remote radio unit, an optical fiber terminal, or the like. Cables using the cable connector assembly 202 may be, for example, electrical cables or optical cables.

One embodiment of the cluster connector assembly system 201 of the present invention will be described in conjunction with FIGS. 12 to 15*d*, in which a remote radio unit and electrical cables are used as an example for an operational scenario.

Figure 12:
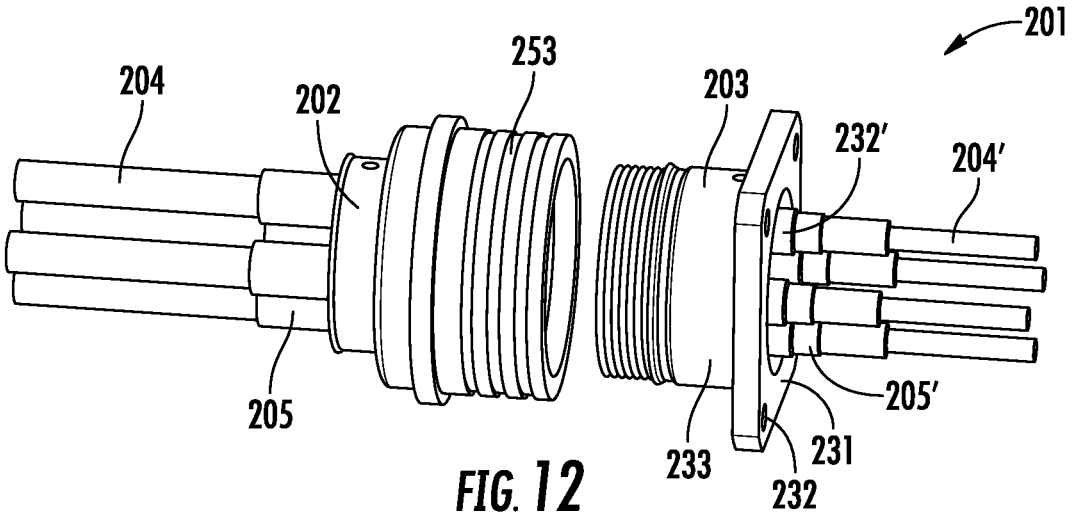
FIG. 12 shows a schematic perspective view of a cable connector assembly and a device connector assembly of a cluster connector assembly system according to one embodiment of the present invention in such a state as to be disengaged from each other.

Referring to FIG. 12, the cluster connector assembly system 201 may include a cable connector assembly 202 on a left side and a device connector assembly 203 on a right side. In the following description, the left-to-right direction of the cable connector assembly 202 corresponds to its rear-to-front direction, and the right-to-left direction of the device connector assembly 203 corresponds to its rear-to-front direction.

The two connector assemblies 202, 203 may be cylindrical as a whole and integrate four connectors 205, 205' with cables 204, 204', respectively. In other embodiments, the two connector assemblies 202, 203 may be in a rectangular parallelepiped shape, a crucifor arrangement, or other shapes, and may integrate other numbers of connectors 205, 205' than four.

Figure 13:
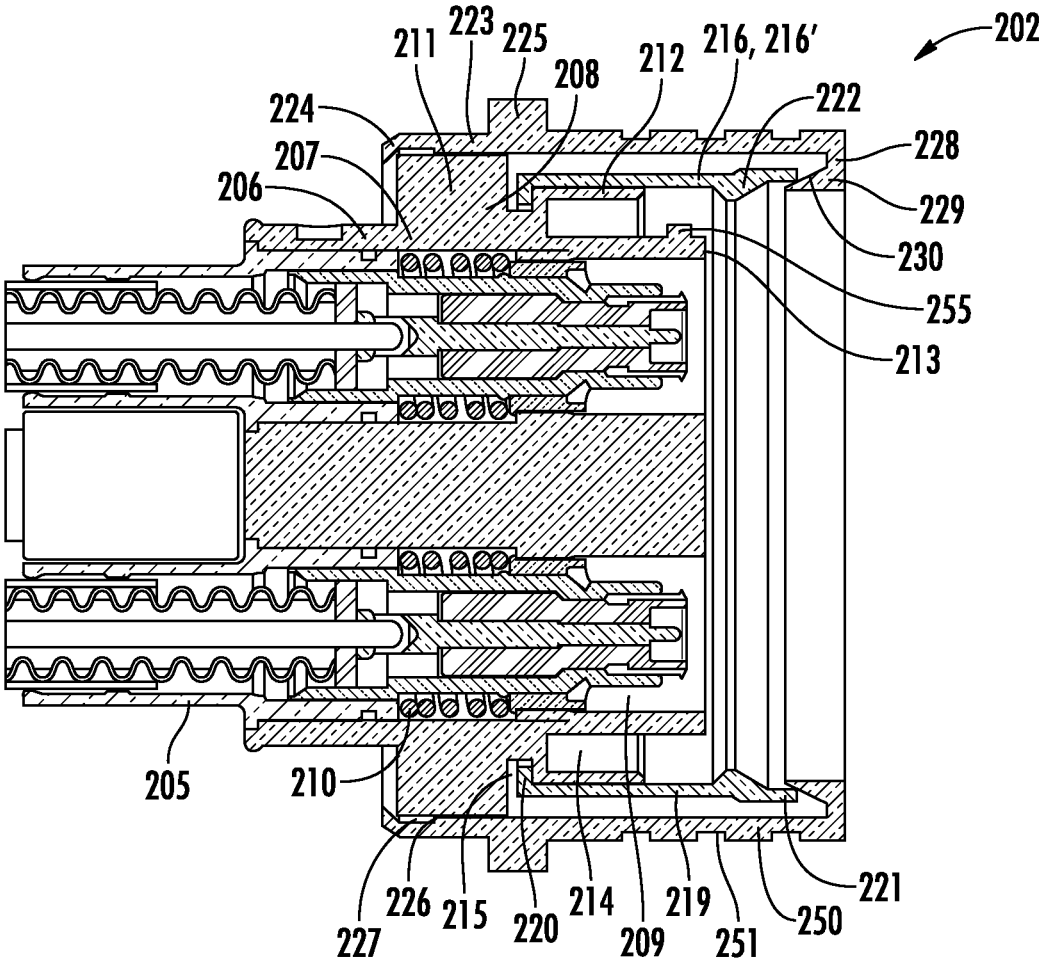
FIG. 13 shows a schematic longitudinal cross-sectional view of the cable connector assembly in FIG. 12.

Referring to FIG. 13, the cable connector assembly 202 may have a housing 6, which may have two functional portions 7, 8, that is, a radially inner portion 207 located radially inward of the housing 206 that may integrate a plurality of connectors 205 of the cable connector assembly 202 and a radially outer portion 208 located radially outward of the housing 206 that is configured for connection with the device connector assembly 203.

The radially inner portion 207 of the housing 206 may have a substantially cylindrical shape, and have a plurality of (four here) through holes 209, each of which may accommodate one connector 205 of the cable connector assembly 202. Each connector 205 may be accommodated in one through-hole 209 in a floated axially manner, for example, by means of one coil spring 210. The radially inner portion 207 of the housing 206 may be an existing functional portion of any type for integrating a plurality of connectors 205 of the cable connector assembly 202 together.

The radially outer portion 208 of the housing 206 may have a base 211 that may extend radially outward from an axially substantially central portion of an outer circumferential surface of the radially inner portion 207. The base 211 may have a receiving groove 215 at a front thereof. The receiving groove 215 may extend along a circumferential direction of the base 211 and may be opened radially outward.

The radially outer portion 208 of the housing 206 may also have a flange 212 located on a front side of the receiving groove 215. The flange 212 may extend axially forward from a substantially middle portion of a front end surface of the base 211 and may extend beyond a front end surface 213 of the radially inner portion 207. In other embodiments, the flange 212 may extend until it is flush with or goes beyond the front end surface 213 of the radially inner portion 207. The flange 212 may form an annular slot 214 with a front of the radially inner portion 207.

Figure 14A:
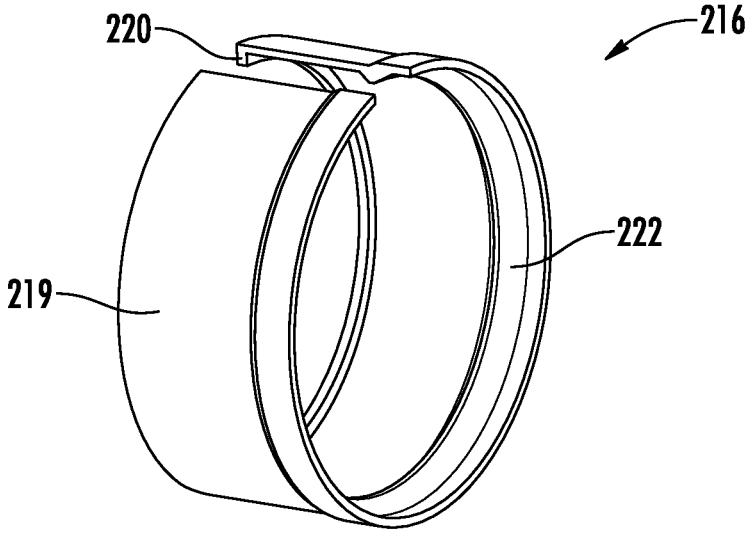
FIG. 14*a* shows a schematic perspective view of a split ring of the cable connector assembly in FIG. 12 according to a first embodiment.
Figure 14B:
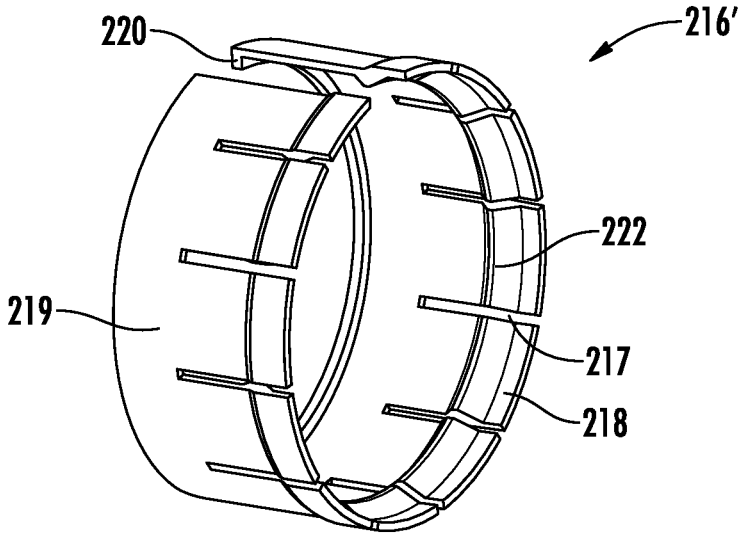
FIG. 14*b* shows a schematic perspective view of a split ring of the cable connector assembly in FIG. 12 according to a second embodiment.

The cable connector assembly 202 may have a split ring 216, 216'. FIG. 14*a* shows a split ring 216 constructed according to a first embodiment, and FIG. 14*b* shows a split ring 216' constructed according to a second embodiment. The split ring 216, 216' may be made from an elastic material, such as stainless steel. The split ring 216, 216' substantially presents a hollow cylindrical shape, and may have one opening in its circumferential direction, so that the split ring 216, 216' may elastically contract and expand radially.

Referring to FIGS. 14*a*, 14*b* and FIG. 13, the split ring 216, 216' may have a body portion 219 extending linearly along an axial direction, and the inner circumferential surface of the body portion 219 may abut against the outer circumferential surface of the flange 212 with a rear portion thereof. The abutment may be carried out in a relaxed state of the split ring 216, 216' or in the case of a radially inward preload formed by itself.

The rear end portion of the split ring 216, 216' may form a bent portion 220 adjacent to the rear end of the body portion 219 and extending radially inward. The bent portion 220 may extend over an entire circumference of the split ring 216, 216'. The bent portion 220 may be accommodated in the receiving groove 215, which may axially stop the split ring 216, 216'. The circumferential length of the bent portion 220 may be equal to or less than the circumferential length of the receiving groove 215. For example, the receiving groove 215 may be an annular groove that is circumferentially enclosed. The radial height of the bent portion 220 may be equal to or smaller than the radial depth of the receiving groove 215 so that the groove bottom of the receiving groove 215 does not impede the body portion 219 from abutting against the flange 212. The axial width of the bent portion 220 may be equal to or smaller than the axial width of the receiving groove 215 so that the bent portion 220 may freely enter and exit the receiving groove 215 radially when the split ring 216, 216' expands or contracts radially.

The front end portion of the split ring 216, 216' may form an abutment portion 221 adjoining a front end of the body portion 219 and extending linearly along an axial direction. The abutment portion 221 may extend over an entire circumference of the split ring 216, 216'. The abutment portion 221 may be offset radially outward with respect to the body portion 219. In other embodiments, the abutment portion 221 may be flush with the body portion 219 or may be a continuation of the body portion 219.

The split ring 216, 216' may have a protrusion 222 protruding radially inwardly beyond the inner circumferential surfaces of the body portion 219 and the abutment portion 221 at a transition between the body portion 219 and the abutment portion 221. The protrusion 222 may extend over an entire circumference of the split ring 216, 216'. The protrusion 222 may have a substantially triangular cross-section. In other embodiments, the protrusion 222 may have a semicircular, trapezoidal, square, or other suitable cross-section. The protrusion 222 may be located in front of the flange 212. The radial maximum height of the protrusion 222 may be equal to the thickness of the flange 212. The protrusion 222 may be arranged axially offset from the radially inner portion 207. In other embodiments, the protrusion 222 may be provided to at least partially overlap with the radially inner portion 207.

The difference between the split ring 216' and the split ring 216 is that the split ring 216' may additionally have a plurality of slits 217 extending axially backward from its front end surface by a certain distance. The distance should be smaller than the axial length of the split ring 216'. These slits 217 may be evenly distributed along a circumferential direction of the split ring 216'. One finger portion 218 may be formed between every two adjacent slits 217, respectively. The protrusion 222 may be disposed on the finger portions 218, for example, a front of the finger portions 218, of the split ring 216'.

The diameter of the split ring 216, 216' may be 41 mm-42 mm, but the actual size may be changed according to actual application. The axial length of the split ring 216, 216' may be 18.50 mm-19.50 mm, but the actual size may be changed according to actual application. The radial thickness of the split ring 216, 216' may be 0.75 mm-1.25 mm, but the actual size may be changed according to an actual application.

As seen from FIG. 13, the cable connector assembly 202 may have a sliding sleeve 223 which may slide reciprocally along an axial direction on an outer circumferential surface of the housing 6, specifically on the outer circumferential surface of the base 211.

The sliding sleeve 223 presents a substantially hollow cylindrical shape, and may have a body portion 250. When the split ring 216, 216' abuts against the flange 212, the body portion 250 may be parallel to the body portion 219 and the abutment portion 221 of the split ring 216, 216'. The body portion 250 may be radially spaced apart from the abutment portion 221 by a distance that may be greater than the radial maximum height of the protrusion 22. As a result, before the split ring 216, 216' expands radially outward to interfere with the body portion 250, the protrusion 222 may move radially outward beyond its radial maximum height. The sliding sleeve 223 may have a structure 251, such as a convex-concave structure on an outer circumferential surface of its body portion 250, which is convenient for an operator to grip the same, and which may constitute a gripping portion 253 of the sliding sleeve 223.

The sliding sleeve 223 includes a front end portion on a front side of its body portion 250. The front end portion may be constructed in a hook shape, and may have a transition portion 228 extending radially inward from a front peripheral edge of the body portion 250 and a spade portion 229 extending axially backward from an inner peripheral edge of the transition portion 228. The radially outer circumferential surface of the spade portion 229 may form a bevel 230 inclined with respect to the abutment portion 221 of the split ring 216, 216'. The spade portion 229 may always abut against an inner edge on a front end of the abutment portion 221 by its bevel 230.

The rear end portion 224 of the sliding sleeve 223 may be processed via crimping after the sliding sleeve is sleeved on the housing 206 from front to back, that is, crimped or tilted radially inward, so that the rear end portion 224 of the sliding sleeve 223 may abut against a rear edge of the base 211. As a result, it is possible to define a sliding stroke of the sliding sleeve forward. The sliding sleeve 223 may have a support flange 225 extending radially outward at a rear of its outer circumferential surface. The support flange 225 may be configured to support the sliding sleeve 223 when crimping the rear end portion 224 of the sliding sleeve. The sliding sleeve 223 may have a stepped portion 226 at a rear of its inner circumferential surface, and the sliding sleeve may form a gap 227 with the base 211 behind the stepped portion 226. The gap 227 may prevent the sliding sleeve from being locked on the base 211 after crimping so that it is impossible to move axially.

When the operator does not slide the sliding sleeve 223 backward, the body portion 219 of the split ring 216, 216' may abut against the flange 212, and the inner edge on a front end of the abutment portion 221 may abut against a rear of the bevel 230 of the spade portion 229. At this time, referring to FIG. 13, the rear end portion 224 of the sliding sleeve 223 may abut against the base 211. Here, the split ring 216, 216' may prevent the sliding sleeve 223 from sliding backwards based on its own elastic force. The state in which the split ring 216, 216' is situated here may be referred to as a radial initial state. In other embodiments, in the initial state of the split ring 216, 216', the abutment portion 221 may be slightly pressed radially outwards by the bevel 230 of the spade portion 229 so as to slightly expand radially outward. Here, the initial state of the split ring 216, 216' may be a completely relaxed state of the split ring 216, 216' in which the split ring 216, 216' is neither subjected to its own preload nor subjected to a radially outward pressure of the spade portion 229, and may also be a state in which it is subjected to a radially inward preload and/or a slight radially outward pressure of the spade portion 29.

When the operator slides the sliding sleeve 223 backward from a position shown in FIG. 13, the bevel 230 of the spade portion 229 may slide backward and may apply a radially outward force component to the abutment portion 221 based on its inclination. As a result, the abutment portion 221 may be expanded to move radially outward, and the abutment portion 221 may drive the protrusion 222 and other portions of the split ring 216, 216' to move radially outward.

For the split ring 216, when the sliding sleeve 223 is made to slide backward, the split ring 216 may expand radially outward over its entire axial length synchronously and at the same extent. For the split ring 216', based on the presence of the slits 217 or the finger portions 218, a front of the split ring 216' may expand radially outward to a greater extent than their rear. As a result, when the split ring 216' is used, there is a need to overcome a small elastic force of the split ring 216' so as to slide the sliding sleeve 223 backward, which facilitates the operation of the sliding sleeve 223.

Referring to FIG. 12 and FIGS. 15*a* to 15*d*, the device connector assembly 203 may have a mounting plate 231 which may have threaded holes 232 on its circumferential edge. By means of the threaded holes, the mounting plate 231 may be mounted onto the device, for example the remote radio frequency unit. The mounting plate 231 may have one central opening 232' through which all (four here) connectors 205' of the device connector assembly 203 may pass.

The housing 233 of the device connector assembly 203 may be disposed on the mounting plate 231 and extend from the mounting plate 231 toward the front (left side in FIGS). The housing 233 may be formed by injection molding. For example, it may be injection molded together with the mounting plate 231. Of course, it may also be manufactured by conventional machining.

Figure 15A:
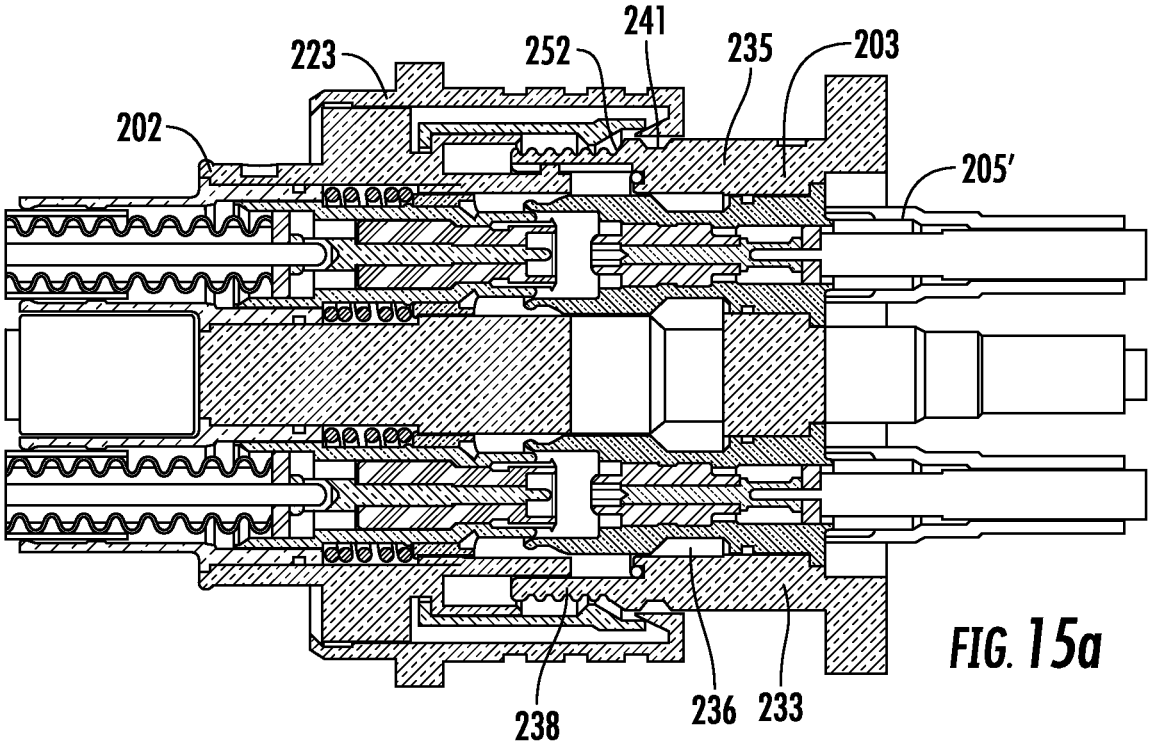
FIG. 15*a* shows a schematic longitudinal cross-sectional view of the cable connector assembly and the device connector assembly of FIG. 12 in a state to be engaged.

Referring to FIG. 15*a*, the housing 233 of the device connector assembly 203 may have a body portion 235. The radially inner portion of the body portion 235 may integrate a plurality of connectors 205' of the device connector assembly 203 together, and the radially outer portion may be configured for connection with the cable connector assembly 202. The body portion 235 of the housing 233 may have a substantially cylindrical shape, and have a plurality of (four here) through holes 236, each of which may fixedly receive one connector 205' of the device connector assembly 203. The body portion 235 of the housing 233 may be an existing functional portion of any type for integrating the plurality of connectors 205' of the device connector assembly 203 together.

The diameter of the outer circumferential surface of the body portion 235 may be equal to or slightly smaller than the diameter of the inner circumferential surface of the spade portion 229 of the sliding sleeve 223, so that the body portion 235 may not be impeded by the spade portion 229 of the sliding sleeve 223 when the cable connector assembly 202 is engaged with or disengaged from the device connector assembly 203. The outer circumferential surface of the body portion 235 may have the same diameter as the outer circumferential surface of the flange 212.

Figure 15B:
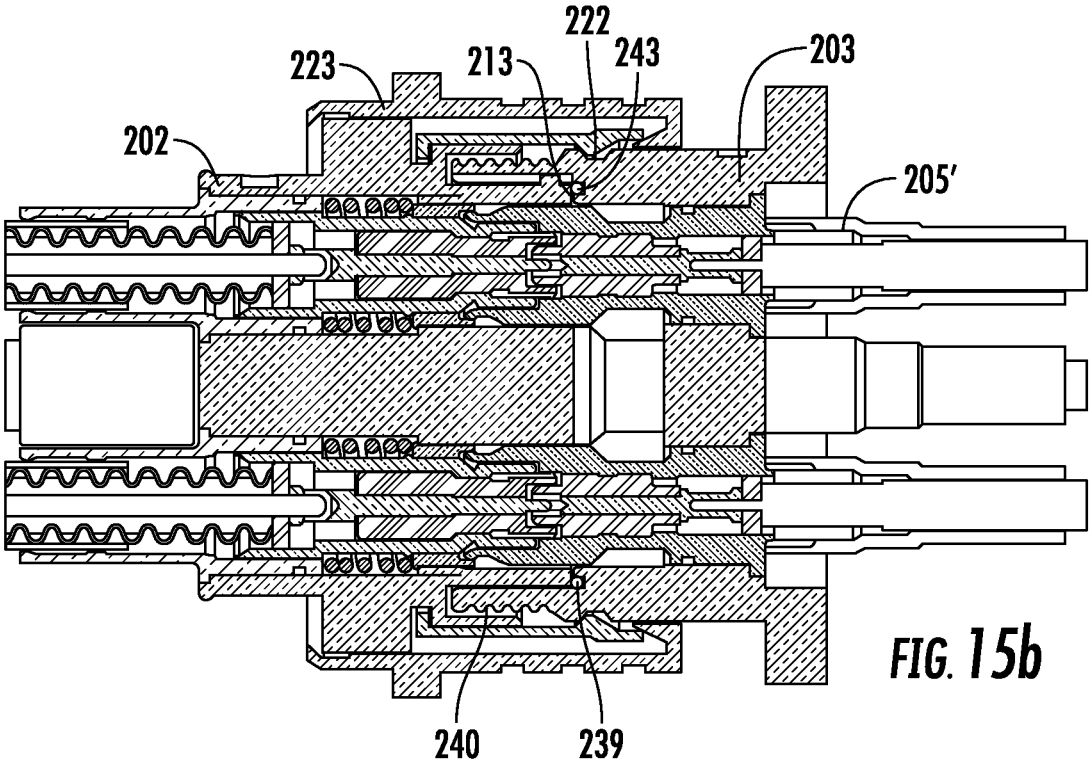
FIG. 15*b* shows a schematic longitudinal cross-sectional view of the cable connector assembly and the device connector assembly of FIG. 12 in an engaged and self-locked state.

The body portion 235 may have one stop groove 241 on the outer circumferential surface, so as to receive the protrusion 222 of the split ring 216, 216'. Referring to FIG. 15*b*, the protrusion 222 may be received in the stop groove 241 and thus may abut against a front side wall of the stop groove 241 by its rear side surface, and the split ring 216, 216' enters the initial state, thereby preventing disengagement of the two connector assemblies 202, 203, that is, implementing self-locking the two connector assemblies 202, 203.

The stop groove 241 may have a tapered cross-section (for example a trapezoidal cross-section) in a direction toward its bottom of the groove, which can facilitate the protrusion 222 to enter the stop groove 241. In other embodiments, the stop groove 241 may have a triangular or square cross-section or a cross-section in other suitable shapes. The axial width and the radial depth of the stop groove 241 may be large enough so that the stop groove 241 may receive the protrusion 222 of the split ring 216, 216'. The circumferential length of the stop groove 241 may be equal to or greater than the circumferential length of the protrusion 222. For example, the stop groove 241 may be an enclosed annular groove.

The position where the stop groove 241 is provided on the body portion 235 may always correspond to the position where the protrusion 222 is provided on the split ring 216, 216' or the flange 216 in a way such that in the engaged state of the two connector assemblies 202, 203, that is, in a state that the front end surfaces 213, 243 of the radially inner portion 207 and the body portion 235 of the two connector assemblies 202 and 203 abut against each other, the split ring 216, 216' may enter its initial state. That is, the protrusion 222 may enter the stop groove 241, so as to implement self-locking the two connector assemblies 202, 203.

Figure 15C:
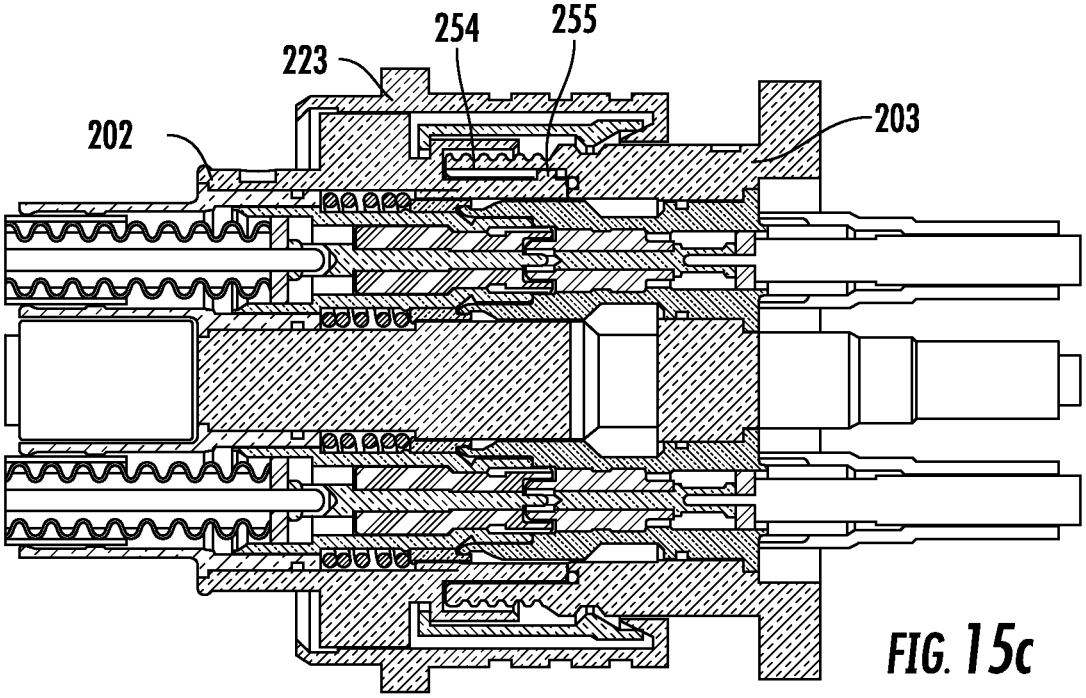
FIG. 15*c* schematically shows a schematic longitudinal cross-sectional view of the cable connector assembly and the device connector assembly of FIG. 12 in an engaged and unlocked state.

FIG. 15*c* shows that the two connector assemblies 202, 203 are in an engaged but unlocked state. Here, the sliding sleeve 23 has been made to slide backwards relative to the housing 206, so that the split ring 216, 216' has been pressed by the spade portion 229 and expanded until the protrusion 222 completely leaves the stop groove 241, thereby implementing unlocking the two connector assembly 202, 203. The state in which the split ring 216, 216' is situated here may be defined as an expanded state.

For this reason, the maximum backward sliding stroke of the sliding sleeve 223 should be long enough, so that the spade portion 229 may at least expand the split ring 216, 216' until the protrusion 222 completely leaves the stop groove 241, that is, the split ring 216, 216' may enter an expanded state. In the expanded state of the split ring 216, the elastic force of the split ring 216 itself may be 40N-50N. In the expanded state of the split ring 216', the elastic force of the finger portions 218 of the split ring 216' itself may be ION-30N.

Therefore, the split ring 216, 216' may have two states herein, i.e. the initial state and the expanded state mentioned above. Referring to FIG. 15*b*, in the initial state of the split ring 216, 216', the protrusion 222 may enter the stop groove 241 to implement self-locking the two connector assemblies 202, 203. Referring to FIG. 15*c*, in the expanded state of the split ring 216, 216', the protrusion 222 may completely leave the stop groove 241 to implement unlocking the two connector assemblies 202, 203.

After the two connector assemblies 202, 203 enter into engagement, it is possible to implement self-locking both of them based on own elastic force or return force of the split ring 216, 216'. That is, in the case where the operator does not manually slide the sliding sleeve 23 backward, the split ring 216, 216' may enter and remain in the initial state based on its own elastic force. Moreover, in order to unlock both of them, the operator is required to manually slide the sliding sleeve 223 backward to overcome the own elastic force of the split ring 216, 216'. That is, when the operator pulls the sliding sleeve 223 backward, the spade portion 229 may make the split ring 216, 216' expand radially outwards in the case of overcoming its own elastic force, so that the protrusion 222 completely leaves the stop groove 241, and the split ring 216, 216' may thus enter an expanded state.

The housing 233 may also have a flange 238 for insertion into the slot 214 of the cable connector assembly 202. The flange 238 may extend axially forward from the outer peripheral edge of the front end surface of the body portion 235. The diameter of the outer circumferential surface of the flange 238 may be equal to or slightly smaller than the diameter of the outer side wall of the slot 214, and the diameter of the inner circumferential surface may be equal to or slightly larger than the diameter of the inner side wall of the slot 214.

The flange 238 may have a positioning groove 254 extending axially on its inner surface, and a positioning projection 255 provided on an outer circumferential surface of the radially inner portion 207 of the cable connector assembly 202 may be received in the positioning groove 254 and guided axially along the same. The positioning projection 255 and the positioning groove 254 may function cooperatively to correctly position the two connector assemblies 202, 203 in a circumferential direction, thereby ensuring that the connectors 205 of the cable connector assembly 202 and the connectors 205' of the device connector assembly 203 are aligned with each other and connected smoothly after engagement. During assembling of the cluster connector assembly system 1, firstly, the positioning groove 254 and the positioning protrusion 255 are aligned with each other, and then the cable connector assembly 202 and the device connector assembly 203 are engaged toward each other.

A stepped portion 252 may be formed between the outer circumferential surface of the flange 238 and the outer circumferential surface of the body portion 235. When the cable connector assembly 202 is engaged with the device connector assembly 223, the protrusion 222 may be flared radially outward by the stepped portion 252. As a result, the protrusion 222 may slide onto the body portion 235. In order to allow that the protrusion 222 can smoothly slide onto the body portion 235, at least one of a stepped surface of the stepped portion 252 and a front side surface of the protrusion 222 should be inclined. For example, both of them may be inclined so that the stepped portion 252 may apply a sufficient radially outward force component to the protrusion 222 to expand the protrusion 222 radially outward.

Referring to FIGS. 15*b* and 15*c*, in a state where the cable connector assembly 202 is engaged with the device connector assembly 203, the flange 238 of the device connector assembly 203 may project into the slot 214 of the cable connector assembly 202, and the front end surface 243 of the body portion 235 of the device connector assembly 203 may abut against the front end surface 213 of the radially inner portion 207 of the cable connector assembly 202. In order to buffer the abutment and seal the abutment location during the engagement, a receiving groove 239 opened toward the front may be provided on the front end surface 243 of the body portion 235, wherein the receiving groove 239 may receive an elastic sealing ring.

Threads 240 (see FIG. 12) may be provided on an outer circumferential surface of the flange 238, so that the device connector assembly 203 can be threadedly connected with a conventional cable connector assembly provided with internal threads. However, the threads are not required for engagement and disengagement of the present invention in a push-pull manner.

Next, the push-pull type engagement and disengagement and self-locking and unlocking processes of the cable connector assembly 202 and the device connector assembly 203 will be described by means of FIGS. 15*a* to 15*d*.

Firstly, the push-pull engagement and self-locking process of the cable connector assembly 202 and the device connector assembly 203 will be introduced. FIG. 15*a* shows that the two connector assemblies 202, 203 are in a state to be engaged. Here, the rear end portion 224 of the sliding sleeve 223 abuts against the rear edge of the base 211 based on own elastic force of the split ring 216, 216', and the split ring 216, 216' is in the initial state.

At this time, the operator may grip the gripping portion 253 and manually push the entire cable connector assembly 202 forward. The protrusion 222 first expands via the stepped portion 252 and in turn reaches the body portion 235. Then, the two connector assemblies 202, 203 abut against each other by the front end surfaces 213 and 243 of the radial inner portion 207 and the body portion 235 to enter an engaged state, the protrusion 222 may reach over the stop groove 241 and enter the stop groove 241 based on own elastic force of the split ring 216, 216' at the same time, thereby reaching the state shown in FIG. 15*b*, that is, a state in which the two connector assemblies 202, 203 are engaged and self-locked. In this state, the two connector assemblies 202, 203 cannot be disengaged from each other.

Next, the unlocking and push-pull disengagement process of the cable connector assembly 202 and the device connector assembly 203 will be introduced. In the engaged state of the two connector assemblies 202 and 203, the operator may grip the gripping portion 253 and manually pull the sliding sleeve 223 backward to move the sliding sleeve 223 backward relative to the housing 211 until the protrusion 222 completely leaves the stop groove 241. That is, the split ring 216, 216' enters the expanded state shown in FIG. 15*c* from the initial state, i.e., a state where the two connector assemblies 202, 203 are engaged, but unlocked. At this time, the two connector assemblies 202, 203 may be disengaged from each other.

Figure 15D:
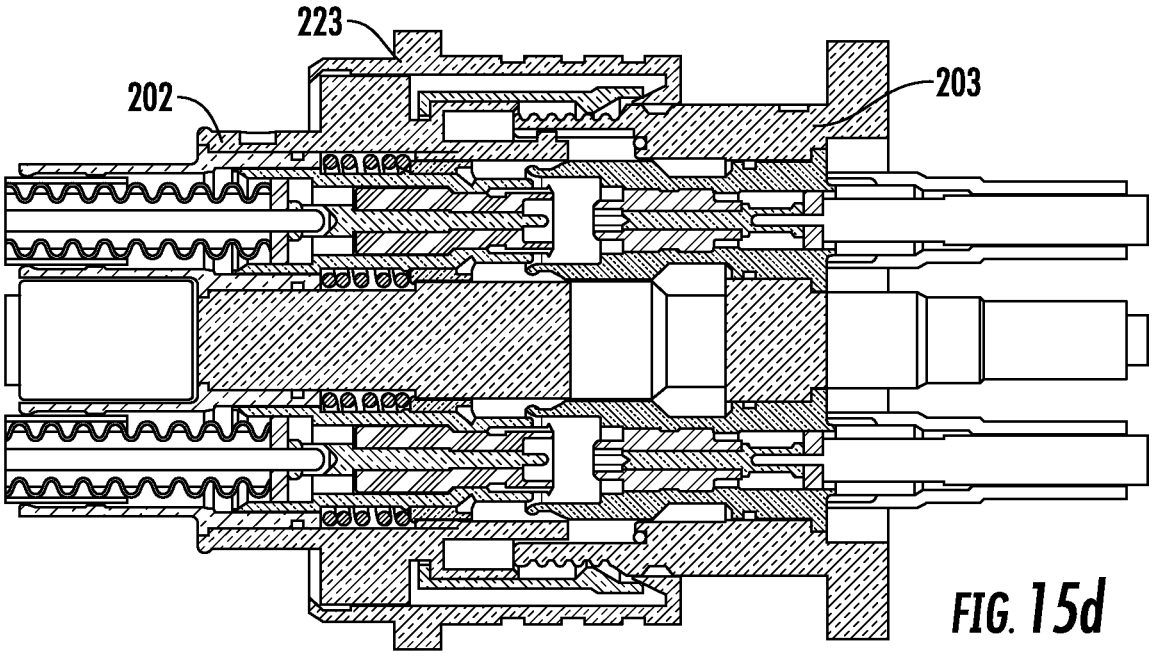
FIG. 15*d* shows a schematic longitudinal cross-sectional view of the cable connector assembly and the device connector assembly of FIG. 12 in a state to be disengaged.

Next, the operator may continue gripping the gripping portion 253 and pulling the entire cable connector assembly 202 backward, so as to reach the state where the two connector assemblies 202, 203 are to be disengaged shown in FIG. 15*d*. Here, once the protrusion 222 leaves the body portion 235, the split ring 216, 216' press the spade portion 229 based on its own elastic force, so that the split ring 216, 216' together with the housing 206 may automatically move backward relative to the sliding sleeve 23 until the split ring 216, 216' enters the initial state.

In the present invention, the positions of the protrusion 222 and the stop groove 241 are interchangeable, that is, the stop groove 241 can be provided on the inner circumferential surface of the split ring 216, 216' of the cable connector assembly 202, and the protrusion 222 may be provided on the outer circumferential surface of the housing 233 of the device connector assembly 203.

Embodiments of the present invention may be advantageous in that they may implement a quick push-pull engagement and disengagement as well as easy self-locking and unlocking of the cable connector assembly 202 and the device connector assembly 203. In addition, the flange 238 of the device connector assembly 203 in the present application may be additionally provided with threads 240, by means of which the device connector assembly 203 may be connected to an existing cable connector assembly provided with threads.

Figure 16:
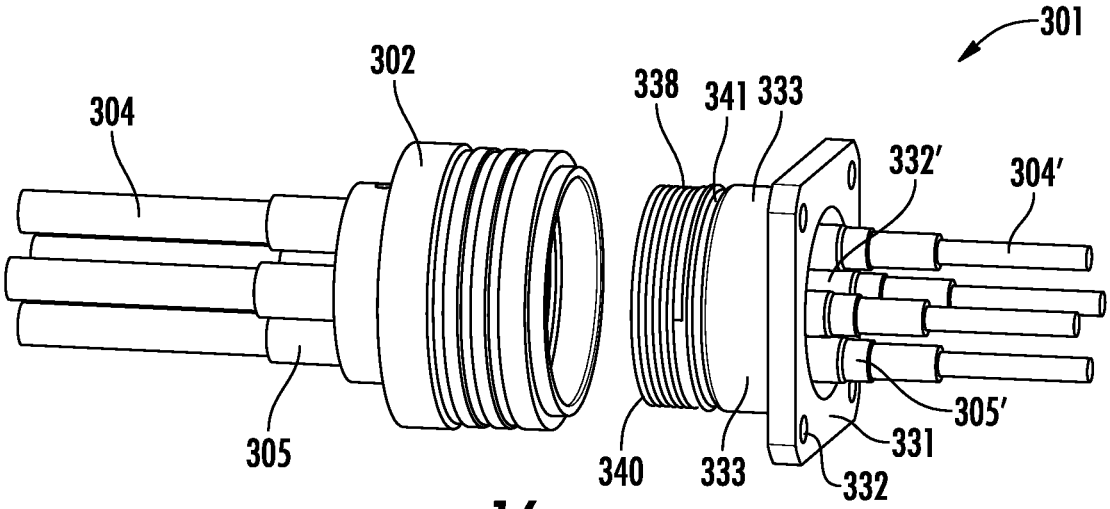
FIG. 16 shows a schematic perspective view of a cable connector assembly and a device connector assembly of a cluster connector assembly system according to one embodiment of the present invention in a disengaged state from each other.

Referring now to FIGS. 16-22*b*, another embodiment of a cluster connector assembly system, designated broadly at 301, is shown therein. Referring first to FIG. 16, the cluster connector assembly system 301 of the present invention may include a cable connector assembly 302 and a device connector assembly 303, both of which may be engaged and disengaged in a push-pull manner, and may be easily self-locked and unlocked after engagement. The device using the device connector assembly 303 may be, for example, a base station antenna, a remote radio unit, an optical fiber terminal, or the like. Cables using the cable connector assembly 302 may be, for example, electrical cables, optical cables, or hybrid cables.

One embodiment of the cluster connector assembly system 301 of the present invention will be described in conjunction with FIGS. 16 to 22*b*, in which a remote radio unit and electrical cables are used as an example for an operational scenario.

Referring to FIG. 16, the cluster connector assembly system 301 may include a cable connector assembly 302 on a left side and a device connector assembly 303 on a right side. In the following description, the left-to-right direction of the cable connector assembly 302 corresponds to its rear-to-front direction, and the right-to-left direction of the device connector assembly 303 corresponds to its rear-to-front direction.

The two connector assemblies 302, 303 may be cylindrical as a whole and integrate four connectors 305, 305' with cables 304, 304', respectively. In other embodiments, the two connector assemblies 302, 303 may be in a rectangular parallelepiped shape, cruciform arrangement, or other shapes, and may integrate other numbers of connectors 305, 305' than four.

Figure 17:
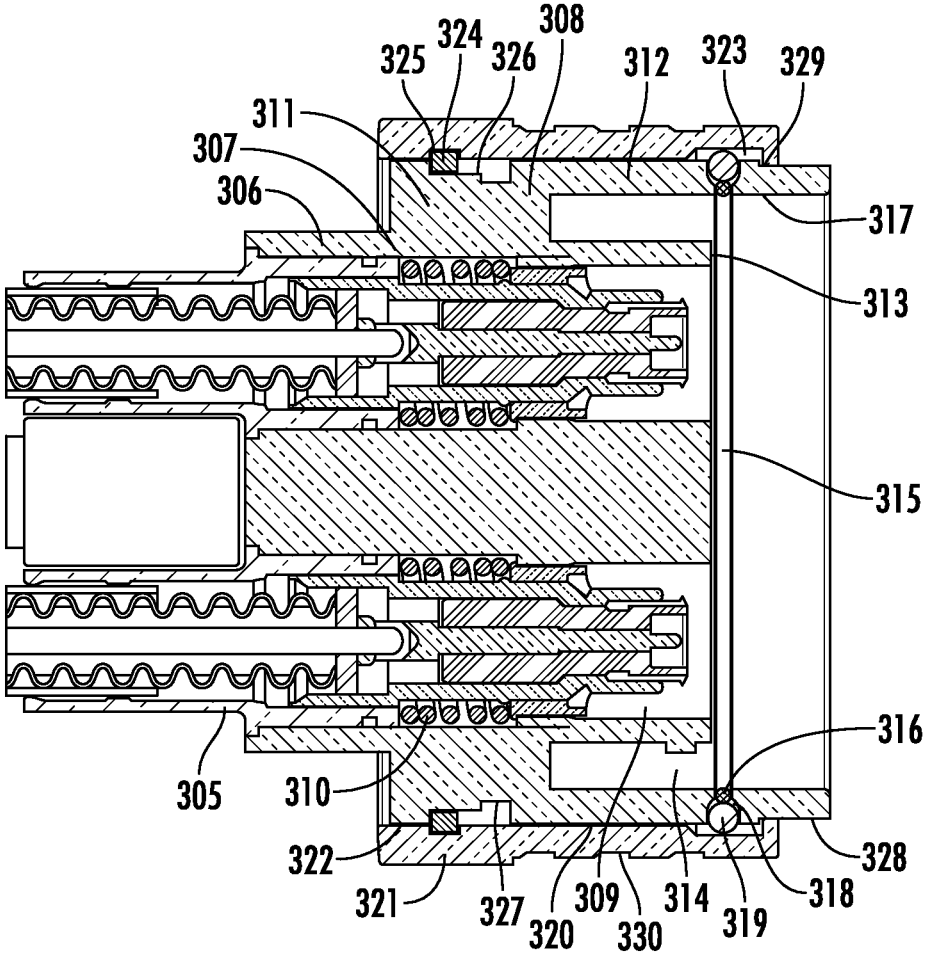
FIG. 17 shows a schematic longitudinal cross-sectional view of the cable connector assembly in FIG. 16.

Referring to FIG. 17, the cable connector assembly 302 may have a housing 306, which may have two functional portions 307, 308: a radially inner portion 307 located radially inward of the housing 306 that may integrate a plurality of connectors 305 of the cable connector assembly 302 and a radially outer portion 308 located radially outward of the housing 306 that is configured for connection with the device connector assembly 303.

The radially inner portion 307 of the housing 306 may have a substantially cylindrical shape, and have a plurality of (four here) through holes 309, each of which may accommodate one connector 305 of the cable connector assembly 302. Each connector 305 may be accommodated in one through-hole 309 in an axially-floated manner, for example, by means of one coil spring 310. The radially inner portion 307 of the housing 306 may be an existing functional portion of any type for integrating a plurality of connectors 305 of the cable connector assembly 302 together.

The radially outer portion 308 of the housing 306 may have a base 311 that may extend radially outward from an axially substantially central portion of an outer circumferential surface of the radially inner portion 307. The radially outer portion 308 of the housing 306 may also have a flange 312 that may extend axially forward from an outer peripheral edge of a front end surface of the base 311 and may extend beyond a front end surface 313 of the radially inner portion 307. The portion of the flange 312 overlapping with the radially inner portion 307 may form an annular slot 314 with the radially inner portion 7.

The flange 312 may have a receiving groove 315 on its inner circumferential surface 317. The receiving groove 315 may extend along a circumferential direction of the flange 312 and may be opened radially inward. The receiving groove 315 may be arranged in a section of the flange 312 axially offset from the radially inner portion 307. In other embodiments, the receiving groove 315 may be arranged in a section of the flange 312 that axially overlaps with the radially inner portion 307.

Figure 18:
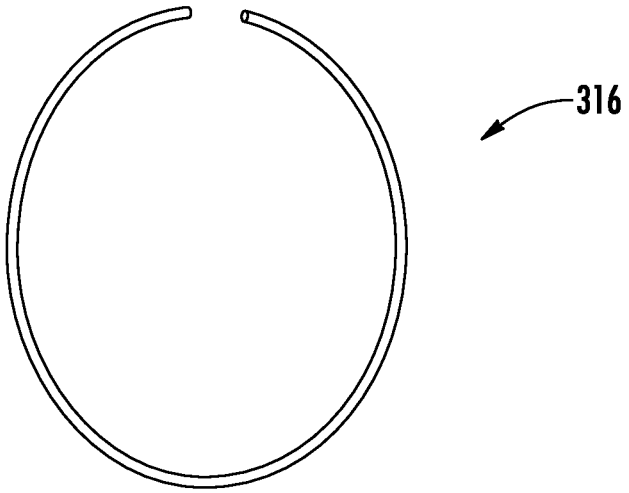
FIG. 18 shows a schematic perspective view of a split ring of the cable connector assembly in FIG. 16.

The cable connector assembly 302 may have a split ring 316. The receiving groove 315 may receive the split ring 316. Referring to FIG. 18, the split ring 316 may be made from an elastic material, such as stainless steel, and may have an opening in its circumferential direction, so that the split ring 316 may radially elastically contract when pressed on its outer periphery and expand after the pressure is removed. The diameter of the split ring 316 may be 41m m-42 mm, and the actual size may be determined according to the size of the receiving groove 315 that receives the split ring 316 in pair. The split ring 316 may have a circular cross-section, and the diameter of the circular cross-section of the split ring 316 may be 0.5 mm-1.0 mm, and the actual size may be determined according to the size of the cross-section of the receiving groove 315 that receives the split ring 316 in pair. In other embodiments, the split ring 316 may have a trapezoidal cross-section or other suitable cross-sectional shapes.

The circumferential length of the receiving groove 315 may be equal to or greater than the length of the split ring 316, for example, it may be an enclosed annular groove. The radial depth of the receiving groove 315 may be equal to or greater than the radial height of the split ring 316.

The split ring 316 may have two states in the receiving groove 315, that is, a radially released state and a contracted state. In its radially released state, the split ring 316 may be completely submerged within the receiving groove 315 in its radially released state. In other words, it may not project radially inward beyond the inner circumferential surface 317 of the flange 312 (see FIG. 17). Moreover, the split ring 316 may be partially submerged within the receiving groove 315 and partially extend radially inward beyond the inner circumferential surface 317 of the flange 312 in its radially contracted state (see FIG. 21*b*).

The released state of the split ring 316 may be an initial state of the split ring 316, that is, a relaxed state that is not subjected to an external force in the radial direction, or may be such a state as to be subjected to a radially inward preload so as to contract slightly. Moreover, the contracted state of the split ring 316 may be in such a state as to be subjected to a radially inward additional force (in addition to a possible radial inward preload subjected), that is, in a more radially inwardly contracted state than a released state.

The flange 312 may have a plurality of (six here) receiving cavities 318 on its radially outer side, which may be distributed on the radially outer side of the receiving groove 315 along a circumferential direction. The receiving cavities 318 may communicate with the receiving groove 315 radially inward, and may be opened radially outward.

Figure 19:
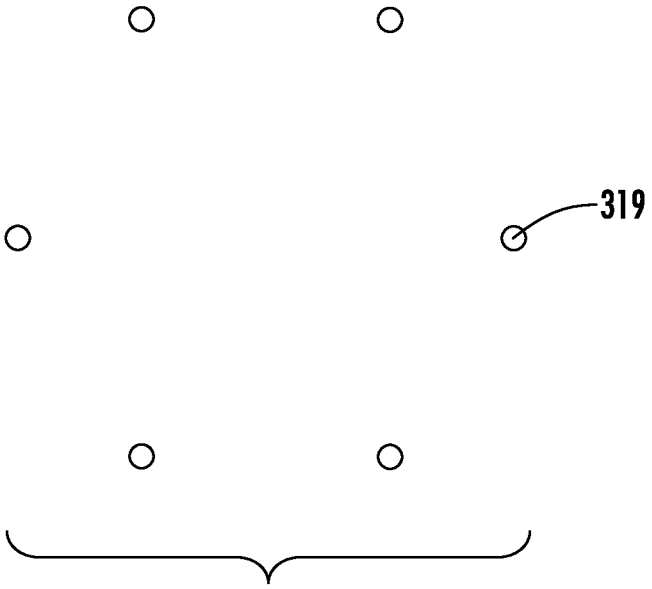
FIG. 19 shows a schematic perspective view of a plurality of balls of the cable connector assembly in FIG. 16.

The cable connector assembly 302 may have balls 319 (see FIG. 19). Each receiving cavity 318 may receive one ball 319, such as a steel ball, that is free to move within the receiving cavity 318. The diameter of the balls 319 may be 1.9 mm-2.0 mm. The radially outward opening size of each receiving cavity 318 may be greater than the diameter of each ball 319 so as to allow the balls 319 to be loaded into the receiving cavities 318 from outside the housing 306. The radial depth of each receiving cavity 318 may be large enough so that one entire ball 319 may be submerged in one receiving cavity 318, that is, it may not extend beyond the outer circumferential surface 320 of the flange 312.

In the receiving cavities 318, the balls 319 may be always abutted against the split ring 316 located on their radially inner side. When each entire ball 319 is submerged in one respective receiving cavity 318, the balls 319 may press the split ring 16 radially inward and may cause the split ring 316 to enter its contracted state.

The axial width of the split ring 316 may be smaller than the diameter of each ball 319. In other embodiments, the axial width of the split ring 316 may be equal to or greater than the diameter of each ball 319.

As may be seen from the drawings, the cable connector assembly 302 may have a sliding sleeve 321 which may slide reciprocally along an axial direction on an outer circumferential surface of the housing 306, specifically on the outer circumferential surface 322 of the base 311 and the outer circumferential surface 320 of the flange 312.

The sliding sleeve 321 at a front thereof may have a release groove 323 opened toward the housing 306, and the release groove 323 has an axial width that is greater than or equal to the radially outward opening width of each receiving cavity 318. When the sliding sleeve 321 slides to a position where the release groove 323 covers the receiving cavities 318 or overlaps with the receiving cavities 318, based on an elastic force of the split ring 316, the split ring 316 may partially press the balls 319 radially outward into the release groove 323, and at the same time, the split ring 316 may be released to enter its released state. The depth of the release groove 323 is smaller than the radius of each ball 319. The portion of each ball 319 entering the release groove 323 cannot exceed half of the ball 319, so that when the sliding sleeve 321 is pushed forward, the balls 319 may be smoothly pressed into the receiving cavities 318 by the rear side wall of the release groove 323 so as to make the opening ring 316 enter its contracted state.

In order to limit the axial sliding stroke of the sliding sleeve 321 on the housing 306 within a certain range, a stop ring 324 may be provided between the sliding sleeve 321 and the housing 306 (for example the base 311), a portion (for example a half) of the stop ring 324 may be received in a corresponding driving groove 325 provided on an inner circumferential surface of the sliding sleeve 321, and the other portion (for example the other half) of the stop ring 324 may be received in a corresponding sliding groove 326 provided in the outer circumferential surface 320 of the base 311.

The driving groove 325 may synchronously drive the stop ring 324 when sliding on the sliding sleeve 321. For this, the axial width of the driving groove 325 may be slightly greater than or equal to the axial width of the stop ring 324.

The axial width of the sliding groove 326 may be greater than the axial width of the stop ring 324 so that the stop ring 324 may slide along the sliding groove 326 when the sliding sleeve 321 slides. The stop ring 324 may abut against a front side wall or a rear side wall of the sliding groove 326, so as to limit a maximum sliding stroke of the sliding sleeve 321. Therefore, the maximum sliding stroke of the sliding sleeve 321 is equal to the axial width of the sliding groove 326 minus the axial width of the driving groove 325.

The maximum sliding stroke of the sliding sleeve 321 may be large enough so that the release groove 323 may enter a position covering the receiving cavities 318 and a position leaving the receiving cavities 318. Specifically, when the sliding sleeve 321 slides backward until the stop ring 324 abuts against a rear side wall of the sliding groove 326, the release groove 323 may cover the receiving cavities 318, and the split ring 316 may partially press the balls 319 into the release groove 323 based on its elastic force, and the split ring 316 may therefore enter the released state (see FIG. 17) from the contracted state. In the released state of the split ring 316, the elastic force of the split ring 16 itself may be 5N~10N. Moreover, when the sliding sleeve 321 slides forward until the stop ring 324 abuts against a front side wall of the sliding groove 326, the release groove 323 may move forward to leave the receiving cavities 318, and the inner circumferential surface of the sliding sleeve 321 behind the release groove 323 may fully press the balls 319 into the receiving cavities 318 against an elastic force of the split ring 316, and the split ring 316 may therefore enter the contracted state from the released state (see FIG. 21*b*). In the contracted state of the split ring 316, the elastic force of the split ring 316 itself may be 15N-20N.

The stop ring 324 may have a square cross-section, thereby implementing reliable abutment of the stop ring 324. Of course, other suitable cross-sectional shapes may also be considered.

Figure 20:
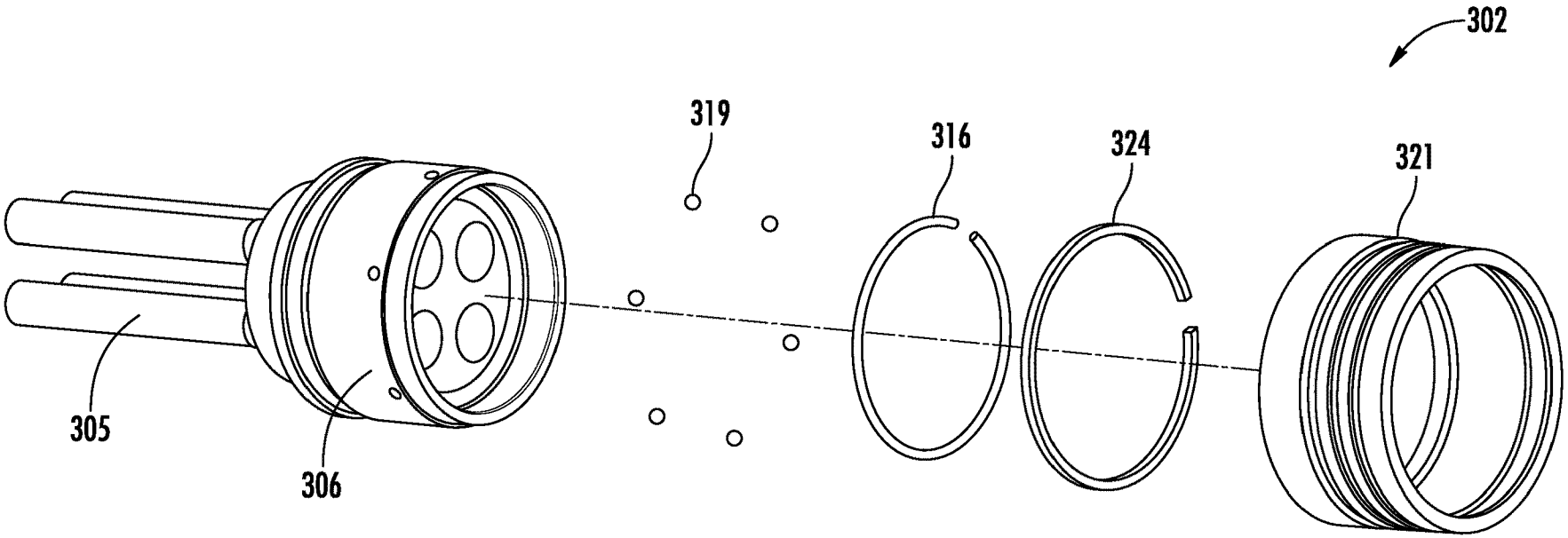
FIG. 20 shows a schematic exploded view of the cable connector assembly in FIG. 16.

In order to be able to easily mount the stop ring 324 within the slide groove 326 of the housing 306, the stop ring 324 may be configured as a split ring (see FIG. 20).

In order to be able to easily mount the stop ring 324 within the driving groove 325 of the sliding sleeve 321, the sliding groove 326 may have a deeper section 327 at a front thereof, and the radial depth of the deeper section 327 may be designed to be greater than or equal to the radial height of the stop ring 324.

During the installation of the sliding sleeve 321, firstly, the entire stop ring 324 may be pressed into the deeper section 327, and then the sliding sleeve 321 may be sleeved on the housing 306 from the front to the rear until the driving groove 325 of the sliding sleeve 321 overlaps with the stop ring 324, and the stop ring 324 may therefore partially enter the driving groove 325 based on its own elastic force, thereby completing the installation of the sliding sleeve 321.

The flange 312 may have a thinner section 328 at a front thereof, and a step portion 329 may be formed at a transition of the outer circumferential surface of the thinner section 328 and the outer circumferential surface of the section behind it. The portion of the sliding sleeve 321 in front of the release groove 323 may slide on the thinner section 328. When the stop ring 324 abuts against the rear side wall of the sliding groove 326, the free end of the front side wall of the release groove 323 may simultaneously abut against a step surface of the step portion 329. The abutment may assist an abutment of the stop ring 324 on the rear side wall of the sliding groove 326. In other embodiments, the thinner section 328 may be omitted.

The sliding sleeve 321 may have a structure 330, such as a convex-concave structure on its outer circumferential surface, which is convenient for an operator to grasp.

FIG. 20 shows a schematic exploded view of the cable connector assembly 302. Referring to FIG. 20, from left to right, cables 305, a housing 306, a plurality of balls 319 arranged circumferentially, a split ring 316 that cooperate with the balls 319 in action, a stop ring 324 and a sliding sleeve 321 are shown.

Referring to FIG. 16 and FIGS. 21*a* to 21*d*, the device connector assembly 303 may have a mounting plate 331 which may have threaded holes 332 on its circumferential edge. By means of the threaded holes 332, the mounting plate 331 may be mounted onto the device, for example the remote radio frequency unit. The mounting plate 331 may have one central opening 332' through which all (four here) connectors 305' of the device connector assembly 303 may pass.

The housing 333 of the device connector assembly 303 may be disposed on the mounting plate 331 and extend from the mounting plate 331 toward the front (left side in FIGS). The housing 333 may be formed by injection molding. For example, it may be injection molded together with the mounting plate 331. Of course, it may also be manufactured by conventional machining.

Figure 21A:
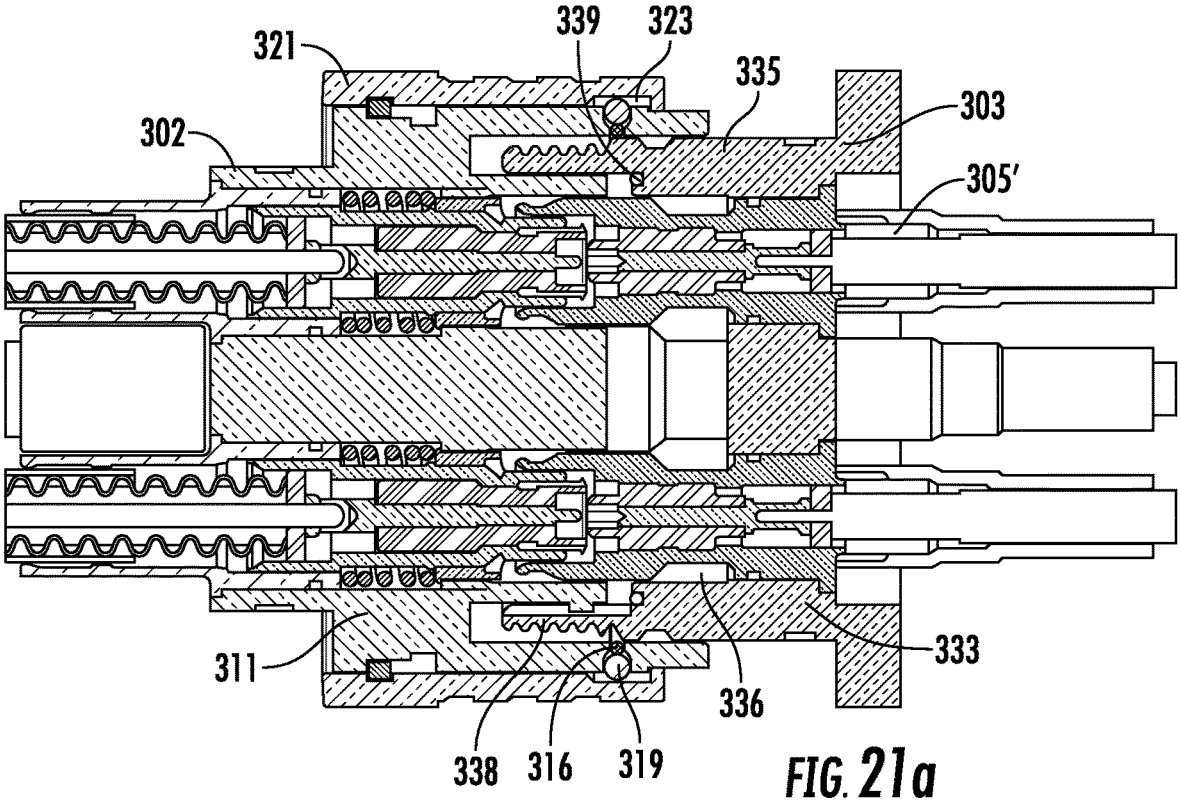
FIG. 21*a* shows a schematic longitudinal cross-sectional view of the cable connector assembly and the device connector assembly of FIG. 16 in a state to be engaged.

Referring to FIG. 21*a*, the housing 333 of the device connector assembly 303 may have a body portion 335. The radially inner portion of the body portion 335 may integrate a plurality of connectors 305' of the device connector assembly 303 together, and the radially outer portion may be configured for connection with the cable connector assembly 302.

The body portion 335 of the housing 333 may have a substantially cylindrical shape, and have a plurality of (four here) through holes 336, each of which may fixedly receive one connector 305' of the device connector assembly 303. The body portion 335 of the housing 333 may be an existing functional portion of any type for integrating the plurality of connectors 305' of the device connector assembly 303 together.

The housing 333 may also have a flange 338 that may extend axially forward from the outer peripheral edge of the front end surface of the body portion 335.

Figure 21B:
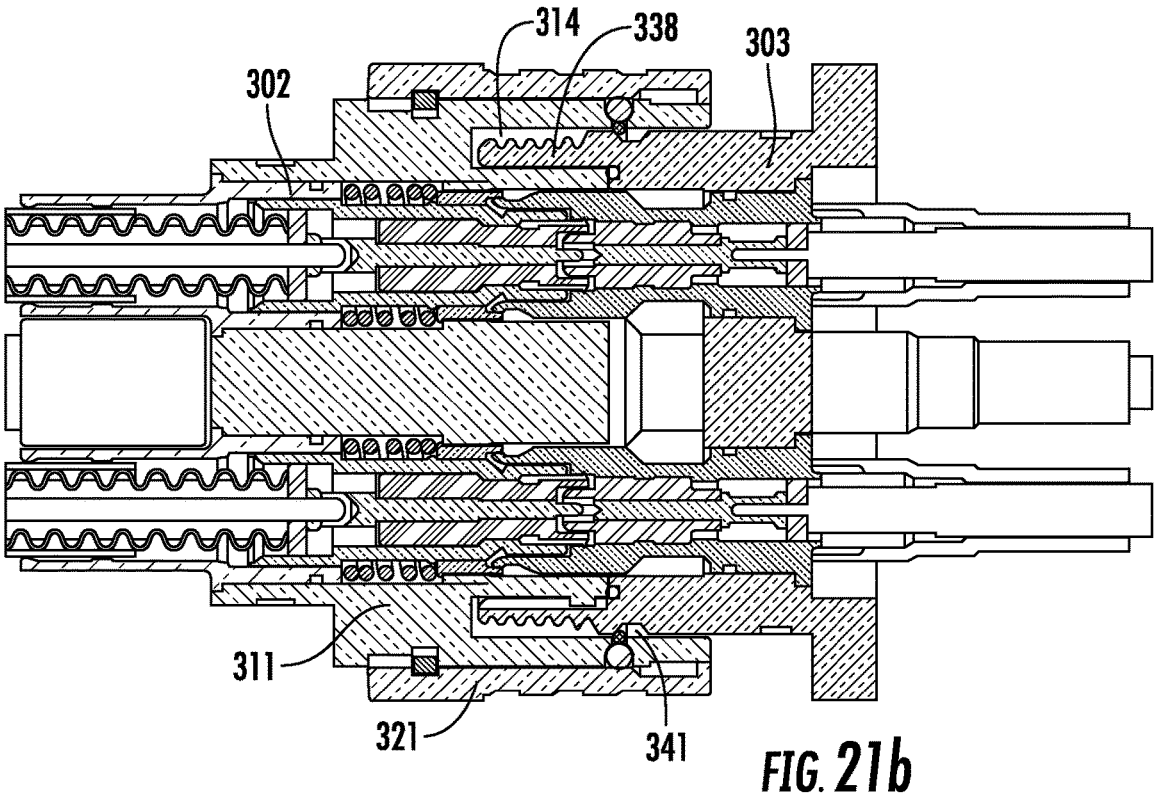
FIG. 21*b* shows a schematic longitudinal cross-sectional view of the cable connector assembly and the device connector assembly of FIG. 16 in an engaged and self-locked state.
Figure 21C:
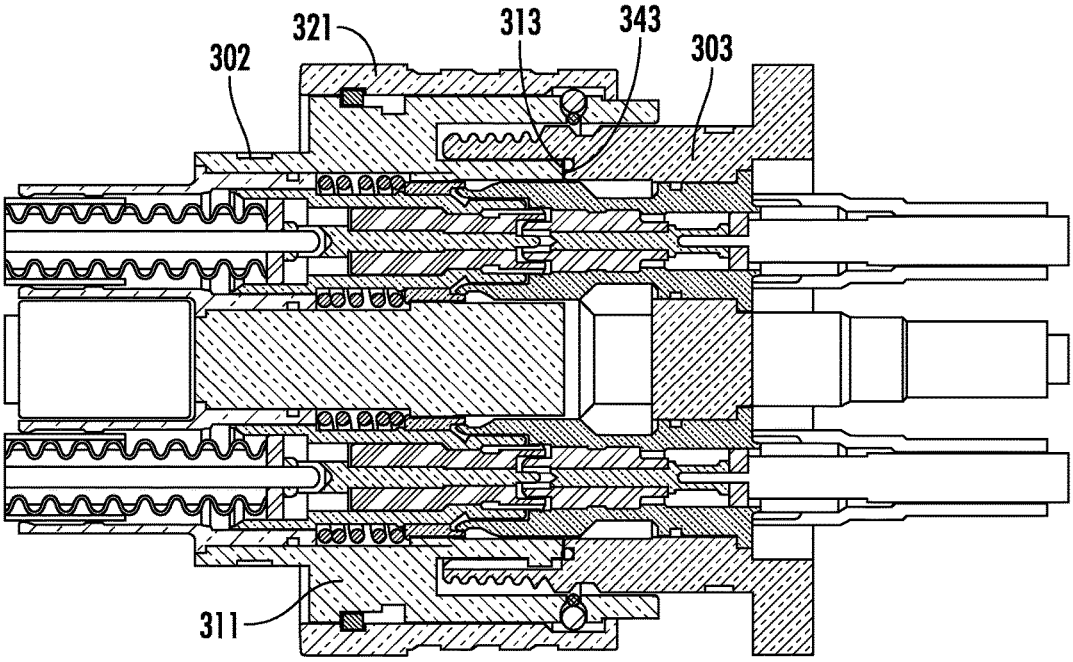
FIG. 21*c* schematically shows a schematic longitudinal cross-sectional view of the cable connector assembly and the device connector assembly of FIG. 16 in an engaged and unlocked state.

Referring to FIGS. 21*b* and 21*c*, in a state where the cable connector assembly 302 is engaged with the device connector assembly 303, the flange 338 of the device connector assembly 303 may project into the slot 314 of the cable connector assembly 302, and the front end surface 343 of the body portion 335 of the device connector assembly 303 may abut against the front end surface 313 of the radially inner portion 307 of the cable connector assembly 302. In order to buffer the abutment and seal the abutment location during the engagement, a receiving groove 339 opened toward the front may be provided on the front end surface 343 of the body portion 335, wherein the receiving groove 339 may receive an elastic sealing ring.

Threads 340 (see FIG. 16) may be provided on an outer circumferential surface of the flange 338, so that the device connector assembly 303 can be threadedly connected with a conventional cable connector assembly provided with internal threads. However, the threads are not required for engagement and disengagement of the present invention in a push-pull manner.

The body portion 335 may have one stop groove 341 on the outer circumferential surface. In other embodiments, the stop groove 341 may also be provided on the outer circumferential surface of the flange 338.

In the contracted state of the split ring 316, the portion of the split ring 316 that projects beyond the inner circumferential surface of the flange 312 may be received in the stop groove 341 and may therefore abut against the front side wall of the stop groove 341 so as to prevent disengagement of the two connector assemblies 302, 303, that is, implementing self-locking the two connector assemblies 302, 303.

The circumferential length of the stop groove 341 may be equal to or greater than the circumferential length of the split ring 316. For example, the stop groove 341 may be an enclosed annular groove. The axial width and the radial depth of the stop groove 341 may be large enough so that it is possible to receive a portion of the split ring 316 that projects beyond the inner circumferential surface 317 of the flange 312 in the contracted state.

The stop groove 341 may have a tapered cross-section (for example a trapezoidal cross-section) in a direction toward its bottom of the groove, which can facilitate the split ring 316 to enter the stop groove 341. In other embodiments, the stop groove 341 may have a square cross-section or a cross-section in other suitable shapes.

The position where the split ring 316 is provided on the flange 312 may always correspond to the position where the stop groove 341 is provided on the body portion 335 or the flange 338 in a way such that in the engaged state of the two connector assemblies 302, 303, that is, in a state that the front end surfaces 313, 343 of the radially inner portion 307 and the body portion 335 of the two connector assemblies 302 and 303 abut against each other, the split ring 316 may enter a contracted state. That is, it may partially project into the stop groove 341, so as to implement self-locking the two connector assemblies 302, 303.

Next, the push-pull type engagement and disengagement and self-locking and unlocking processes of the cable connector assembly 302 and the device connector assembly 303 will be described by means of FIGS. 21*a* to 21*d*.

Firstly, the push-pull engagement and self-locking process of the cable connector assembly 302 and the device connector assembly 303 will be introduced. FIG. 21*a* shows that the two connector assemblies 302, 303 are in a state to be engaged. Here, the balls 319 may be partially received in the release groove 323, and the split ring 316 may therefore be in the released state, thus allowing the flange 338 to freely enter the slot 314.

At this time, the operator may hold the cables 305 of the cable connector assembly 302 or an area of the housing 311 not covered by the sliding sleeve 321, and manually push the entire cable connector assembly 302 forward until the front end faces 313, 343 of the radially inner portion 307 and the body portion 335 of the two connector assemblies 302, 303 abut against each other to enter the engaged state.

Then, the operator may hold the sliding sleeve 321 and manually push the sliding sleeve 321 forward. The sliding sleeve 321 may therefore move forward relative to the housing 311 and may therefore fully press the balls 319 into the receiving cavities 318. At the same time, the balls 319 press the split ring 316 radially inwards, which may overcome its elastic force to enter the contracted state from the released state. A portion of the split ring 316 may therefore enter into the stop groove 341, thereby reaching the state shown in FIG. 21*b*, that is, a state where the two connector assemblies 302, 303 are engaged and self-locked. In this state, the two connector assemblies 302, 303 cannot be disengaged from each other.

Next, the unlocking and push-pull disengagement process of the cable connector assembly 302 and the device connector assembly 303 will be introduced. The operator may manually pull the sliding sleeve 321 backward to move the sliding sleeve 321 backward relative to the housing 311 until the release groove 323 covers the receiving cavities 318. The balls 319 may therefore enter the release groove 323, and at the same time the split ring 3316 enters the released state from the contracted state based on its elastic force, and completely leaves the stop groove 341, thereby reaching the state shown in FIG. 21*c*, that is, a state where the two connector assemblies 302, 303 are engaged, but unlocked.

Figure 21D:
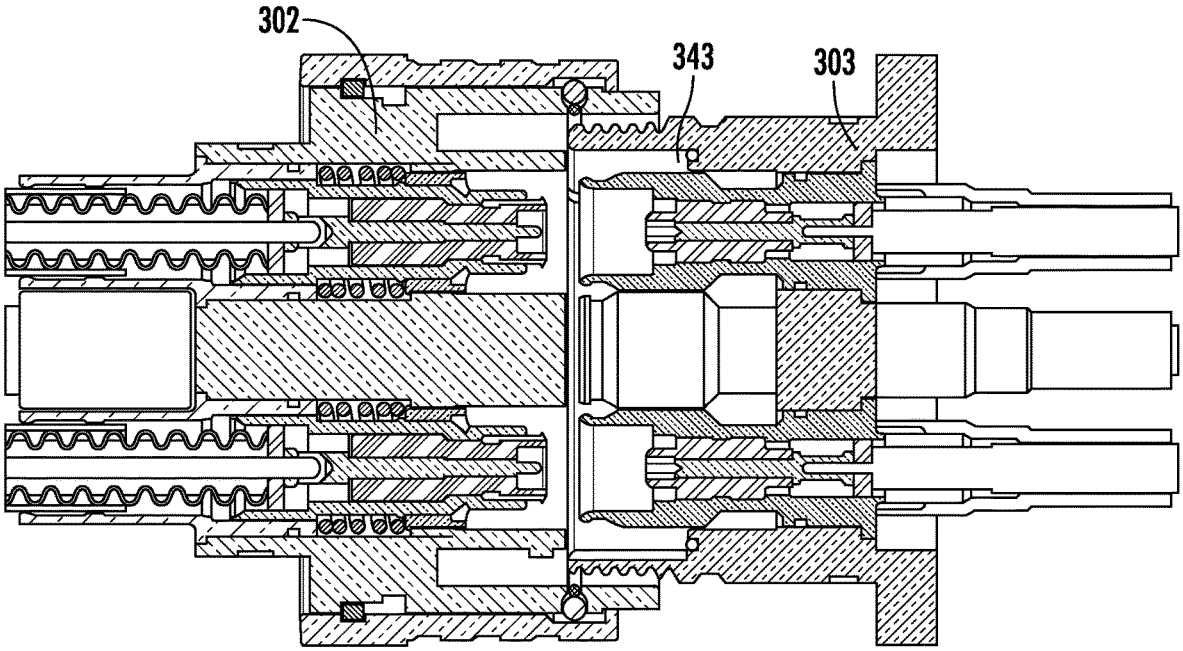
FIG. 21*d* shows a schematic longitudinal cross-sectional view of the cable connector assembly and the device connector assembly of FIG. 16 in a state to be disengaged.

Next, the operator may pull the entire cable connector assembly 302 backwards by holding the sliding sleeve 321 or the cables 305, so that the flange 338 may freely leave the slot 314 to reach a state where the two connector assemblies 302, 303 are to be disengaged shown in FIG. 21*d*.

Figure 22A:
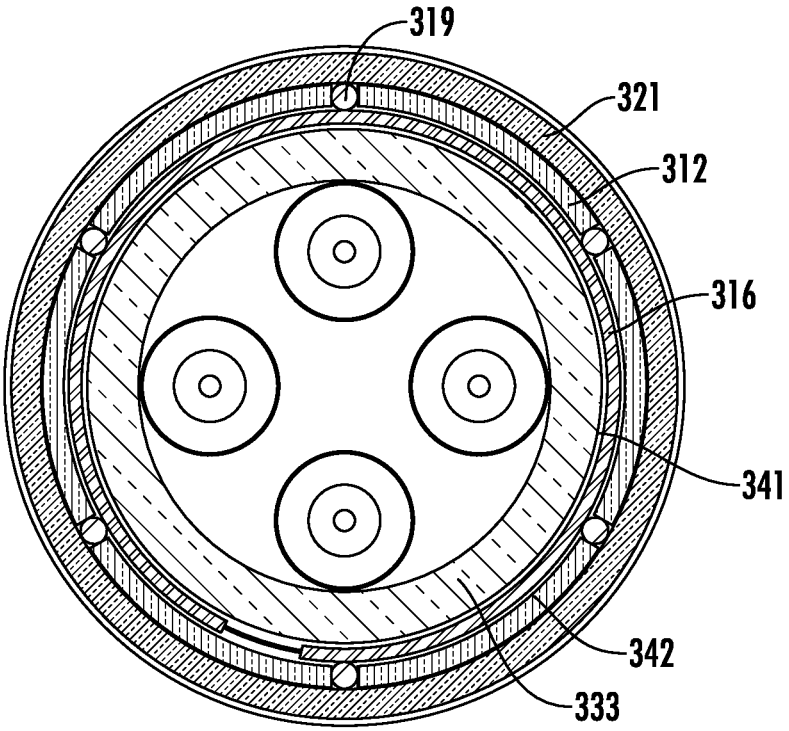
FIG. 22*a* shows a cross-sectional view of the cluster connector assembly system of FIG. 21*b* in a self-locked state which passes through the centers of the balls employed therein.

FIG. 22*a* shows a cross-sectional view of the cluster connector assembly system 301 which passes through centers of the balls 319 in the self-locked state shown in FIG. 21*b*. As may be seen from FIG. 22*a*, the balls 319 may be fully pressed into the receiving cavities 318 of the flange 312 by the sliding sleeve 321, and the split ring 316 partially enters the stop groove 341. Here, it may be seen that there is a gap 342 between the split ring 316 and the groove bottom of the receiving groove 315.

Figure 22B:
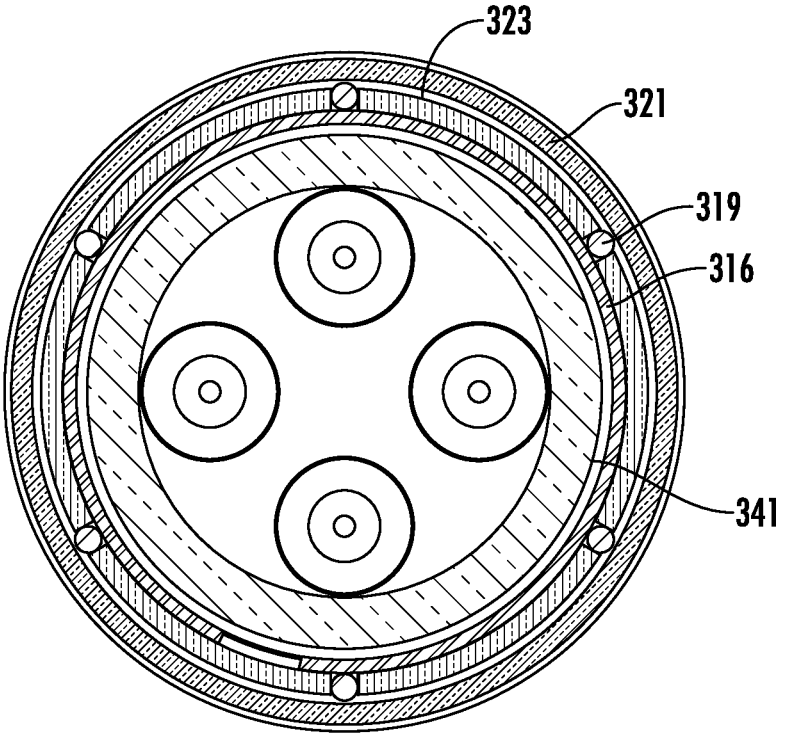
FIG. 22*b* shows a cross-sectional view of the cluster connector assembly system of FIG. 21*c* in the unlocked state which passes through the centers of the balls employed therein.

FIG. 22*b* shows a cross-sectional view of the cluster connector assembly system which passes through centers of the balls 319 in the unlocked state shown in FIG. 21*c*. As may be seen from FIG. 22*b*, the balls 319 may partially enter the release groove 323 of the sliding sleeve 321, and thus release the split ring 316. The split ring 316 may enter the released state based on its own elastic force, and the split ring 316 may completely leave the stop groove 341. Here, it may be seen that the split ring 316 may abut against the groove bottom of the receiving groove 315 so that there is no longer a gap 342.

The present invention is prominent in that it implements a quick push-pull engagement and disengagement as well as easy self-locking and unlocking of the cable connector assembly 302 and the device connector assembly 303. In addition, the flange 338 of the device connector assembly 303 in the present application may be additionally provided with threads 340, by means of which the device connector assembly 303 may be connected to an existing cable connector assembly provided with threads.

Exemplary embodiments according to the present disclosure have been described in detail above with reference to the accompanying drawings. However, those skilled in the art should appreciate that a plurality of changes and modifications may be made to the exemplary embodiments of the present disclosure without departing from the spirit and scope of the present disclosure. All the changes and modifications are encompassed within the protection scope of the present disclosure as defined by the claims. The present disclosure is defined by the appended claims, and the equivalents of these claims are also contained therein.

What is claimed is:

1. A coaxial connector assembly, the coaxial connector assembly comprising: a first connector and a second connector adapted to be connected with each other; and a locking mechanism adapted to lock and unlock a connection between the first connector and the second connector, wherein the locking mechanism includes a first locking member having at least one elastic snap-fit element and a second locking member having a locking element adapted to be snap-fitly engaged with the at least one elastic snap-fit element; wherein the first locking member is disposed on an outer periphery of the first connector, and the second locking member is disposed on an outer periphery of the second connector; and wherein the at least one elastic snap-fit element is constructed as a cantilever that extends axially toward a direction remote from the second connector, so that it is movable between an unlocking position and a locking position along a radial direction, wherein in the unlocking position, the at least one elastic snap-fit element is pressed down so that the at least one elastic snap-fit element is disengaged from the locking element to unlock the connection between the first connector and the second connector, and in the locking position, the at least one elastic snap-fit element springs back to its initial state, so that the at least one elastic snap-fit element is snap-fitly engaged with the locking element to lock the connection between the first connector and the second connector, wherein one of the at least one elastic snap-fit element and the locking element includes a depressed portion, and the other of the at least one elastic snap-fit element and the locking element includes a raised portion, wherein in the locking position, the raised portion projects into the depressed portion to form a snap-fit engagement, wherein the first locking member includes a semicircular or substantially circular body, and one end of each elastic snap-fit element is fixed on the body.

2. The coaxial connector assembly according to claim 1, wherein the at least one elastic snap-fit element is constructed in a stepped shape, and the locking element includes a depressed portion for receiving a raised portion of the stepped shape and a stopper for blocking the raised portion from moving out of the depressed portion along an axial direction, wherein in the locking position, the raised portion of the stepped shape is received in the depressed portion and a stepped surface of the stepped shape abuts against the stopper.

3. The coaxial connector assembly according to claim 1, wherein the second locking member is constructed as a locking sleeve, and the locking element is disposed inside the locking sleeve.

4. The coaxial connector assembly according to claim 1, wherein, in the locking position, a portion of the at least one elastic snap-fit element projects from the second locking member, so that the at least one elastic snap-fit element can be disengaged from the locking element by pressing down on the portion.

5. The coaxial connector assembly according to claim 1, wherein the first locking member includes two elastic snap-fit elements spaced apart by 180°.

6. The coaxial connector assembly according to claim 1, wherein the first locking member includes three or more elastic snap-fit elements uniformly distributed along a circumferential direction of the first connector.

7. A cluster connector assembly system, the cluster connector assembly system comprising a first connector assembly and a second connector assembly, wherein, the first connector assembly has a housing having a first portion configured to integrate a plurality of first connectors together, a second portion located radially outward of the first portion, and a sleeve configured to slide reciprocally along an axial direction on an outer circumferential surface of the housing, wherein a split ring is axially constrainedly arranged on the second portion relative to the housing, the split ring is provided with one of a protrusion and a stop groove on its inner circumferential surface, and the split ring is elastically expandable and contractible in a radial direction, and wherein a peripheral edge of the sleeve extends radially inward and abuts against the split ring, the second connector assembly has a housing configured to integrate a plurality of second connectors together, wherein the housing of the second connector assembly has the other of a protrusion and a stop groove, the first connector assembly and the second connector assembly are engageable and disengageable in a push-pull manner, wherein, when the first connector assembly and the second connector assembly enter an engaged state, the split ring is movable radially inwards based on its own elastic force, so that the protrusion enters the stop groove, thereby establishing self-locking of the first connector assembly and the second connector assembly.

8. The cluster connector assembly system according to claim 7, wherein, when the split ring is pressed radially outward, the split ring is movable radially outward by overcoming its own elastic force, thereby causing the protrusion to leave the stop groove, so that the first connector assembly and the second connector assembly are unlocked.

9. The cluster connector assembly system according to claim 7, wherein the split ring presents a substantially hollow cylindrical shape.

10. The cluster connector assembly system according to claim 7, wherein a front side surface and a rear side surface of the protrusion are configured to be inclined.

11. The cluster connector assembly system according to claim 7, wherein the housing of the first connector assembly has one of a positioning protrusion and a positioning groove extending along an axial direction, and the housing of the second connector assembly has the other of a positioning protrusion and a positioning groove extending along an axial direction, wherein the positioning protrusion is axially guidable in the positioning groove.

12. The cluster connector assembly system according to claim 7, wherein a cross-section of the stop groove is tapered in a direction toward its groove bottom.

13. The cluster connector assembly system according to claim 7, wherein the housing of the second connector assembly has a body portion and a flange extending forward from a front end surface of the body portion, and wherein the stop groove is disposed on the body portion.

14. A cluster connector assembly system, the cluster connector assembly system comprising a first connector assembly and a second connector assembly, wherein, the first connector assembly has a housing having a first portion configured to integrate a plurality of first connectors together and having a second portion located radially outward of the first portion, wherein a split ring and a plurality of balls are axially constrainedly arranged on the second portion relative to the housing, the split ring is elastically expandable and contractible in a radial direction, and the balls are circumferentially distributed so as to be arranged on the same radial side of the split ring, the second connector assembly has a housing configured to integrate a plurality of second connectors together, wherein the housing of the second connector assembly has a stop groove, the first connector assembly and the second connector assembly are engageable and disengageable in a push-pull manner, wherein, in a state where the first connector assembly is engaged with the second connector assembly, when a pressure is applied to the balls so that the balls radially press and drive the split ring radially inwardly, the split ring overcomes its own elastic force to partially enter the stop slot, thereby establishing self-locking of the first connector assembly and the second connector assembly.

15. The cluster connector assembly system according to claim 14, wherein, when the pressure is cancelled, the split ring moves away from the stop groove and drives the balls based on its own elastic force, so that the first connector assembly and the second connector assembly are unlocked.

16. The cluster connector assembly system according to claim 14, wherein the split ring has a circular or trapezoidal cross-section.

17. The cluster connector assembly system according to claim 14, wherein the stop groove is a circumferential groove enclosed along a circumferential direction.

18. The cluster connector assembly system according to claim 14, wherein a cross-section of the stop groove is tapered in a direction toward its groove bottom.

* * * * *